US009597922B2

(12) United States Patent
Suzuki et al.

(10) Patent No.: US 9,597,922 B2
(45) Date of Patent: Mar. 21, 2017

(54) METHOD FOR LIQUID SURFACE ACTIVATION OF TRANSFER FILM, HYDROGRAPHIC METHOD AND HYDROGRAPHIC DEVICE IMPLEMENTING SAME

(75) Inventors: Eiji Suzuki, Fuji (JP); Youichiro Yoshii, Toyota (JP); Katsumi Iyanagi, Shizuoka (JP); Sakae Ushiwata, Shizuoka (JP)

(73) Assignee: TAICA CORPORATION, Tokyo (JP)

( * ) Notice: Subject to any disclaimer, the term of this patent is extended or adjusted under 35 U.S.C. 154(b) by 495 days.

(21) Appl. No.: 14/343,250

(22) PCT Filed: Dec. 8, 2011

(86) PCT No.: PCT/JP2011/078435

§ 371 (c)(1),
(2), (4) Date: Jun. 9, 2014

(87) PCT Pub. No.: WO2013/084339

PCT Pub. Date: Jun. 13, 2013

(65) Prior Publication Data

US 2014/0367024 A1 Dec. 18, 2014

(51) Int. Cl.
*B41F 16/00* (2006.01)
*B44C 1/175* (2006.01)

(52) U.S. Cl.
CPC ..... *B44C 1/1758* (2013.01); *B44C 1/175* (2013.01)

(58) Field of Classification Search
CPC ..... B44C 1/1758; B44C 1/175; B41F 16/00
See application file for complete search history.

(56) References Cited

U.S. PATENT DOCUMENTS

2001/0052296 A1* 12/2001 Niwa ..... B41F 17/006 101/35
2012/0227769 A1 9/2012 Yoshii et al.

FOREIGN PATENT DOCUMENTS

JP A-07-076067 3/1995
JP H07-81037 A 3/1995
JP A-2005-081619 3/2005
(Continued)

OTHER PUBLICATIONS

Jan. 23, 2012 International Search Report issued in International Application No. PCT/JP2011/078435 (with translation).

*Primary Examiner* — Jeff Aftergut
*Assistant Examiner* — Jaeyun Lee
(74) *Attorney, Agent, or Firm* — Oliff PLC

(57) ABSTRACT

Disclosed are an activation method and a liquid pressure transfer technique, where a transfer film is supplied to the surface of a transfer liquid and then is activated, capable of continuously performing a precise transfer. In forming an appropriate transfer pattern on the surface of an object by pressing the object from the upper side of a transfer tank, in the transfer tank, a pre-activation guide mechanism that holds both sides of the film, which is supplied with the center position matching the center of the transfer tank, at horizontally equivalent positions of the transfer tank and guides the film to an activation area is disposed. Accordingly, the film is urged to swell up in the thickness direction, and, in the activation area, the film is coated with an activating agent in a state in which the guide action of the film using the pre-activation guide mechanism is cancelled.

21 Claims, 13 Drawing Sheets

(56) References Cited

FOREIGN PATENT DOCUMENTS

| | | | |
|---|---|---|---|
| JP | A-2006-062180 | | 3/2006 |
| JP | 2006-123264 | A | 5/2006 |
| JP | A-2008-213428 | | 9/2008 |
| JP | A-2011-143593 | | 7/2011 |
| WO | 2011-52636 | A1 | 5/2011 |

* cited by examiner

Fig.6
(a)
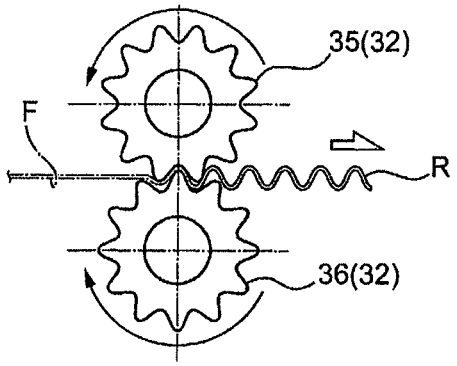
(b)
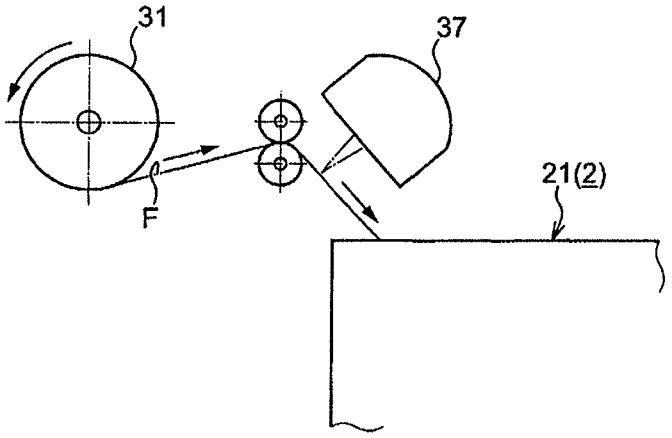
(c)
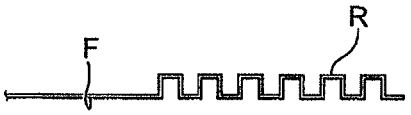

Fig.8
(a)
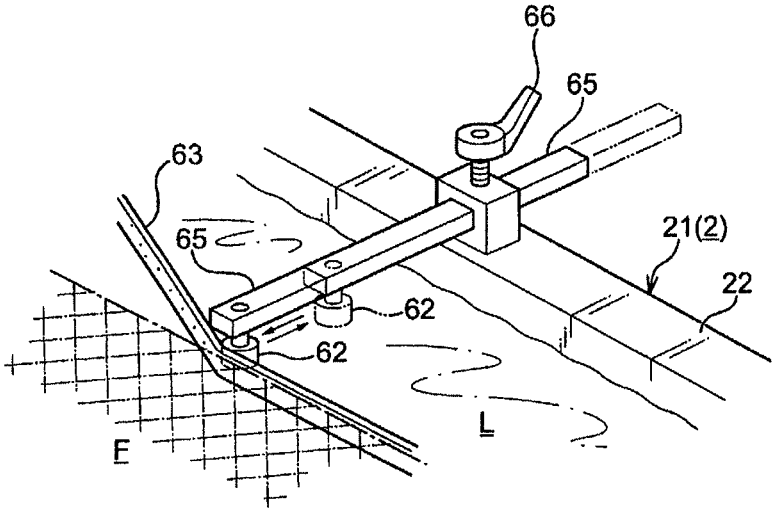
(b)
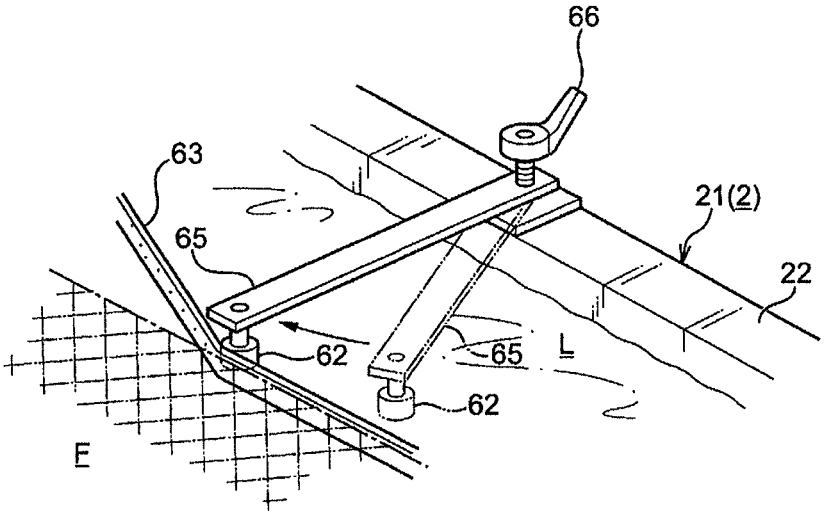

Fig.9

WEEKLY AMOUNT OF TRANSFER, AMOUNT OF REPLACED WATER OF TRANSFER WATER AND CHANGE IN PVA DENSITY IN FACTORY A

| | MONDAY | | TUESDAY | | WEDNESDAY | | THURSDAY | | FRIDAY | |
|---|---|---|---|---|---|---|---|---|---|---|
| PVA DENSITY MEASUREMENT TIME | AT TIME OF STARTING WORK | 847 $m^3$ AFTER USE | REPLACEMENT OF WATER OF 2 TONS | 798 $m^3$ AFTER USE | REPLACEMENT OF WATER OF 3 TONS | 807 $m^3$ AFTER USE | REPLACEMENT OF WATER OF 4 TONS | 854 $m^3$ AFTER USE | REPLACEMENT OF WATER OF 5 TONS | 840 $m^3$ AFTER USE |
| PVA DENSITY (ppm) | 90 | 2,850 | 1,480 | 4,200 | 1,640 | 4,320 | 1,200 | 3,920 | 560 | 3,060 |
| pH | 7 | 4 | 4 | 4 | 5 | 4 | 5 | 4 | 6 | 5 |
| AMOUNT OF REPLACED TRANSFER WATER AFTER COMPLETION OF WORK ($m^3$) | 2 | | 3 | | 4 | | 5 | | 6 | |
| AMOUNT OF USE OF FILM ($m^3$) | 847 | | 798 | | 807 | | 854 | | 840 | |

* CAPACITY OF TRANSFER TANK, SEDIMENTATION/TEMPERATURE ADJUSTMENT TANK : 6m
* EVERY FRIDAY, WHOLE WATER OF TRANSFER TANK, SEDIMENTATION/TEMPERATURE ADJUSTMENT TANK WAS DISCHARGED, FILLED WITH TAP WATER AFTER CLEANING
* AFTER WORK OF MONDAY AMOUNT OF TRANSFER WATER IN TABLE WAS DISCHARGED, AND FILL IN NEW WATER AT FULL LEVEL

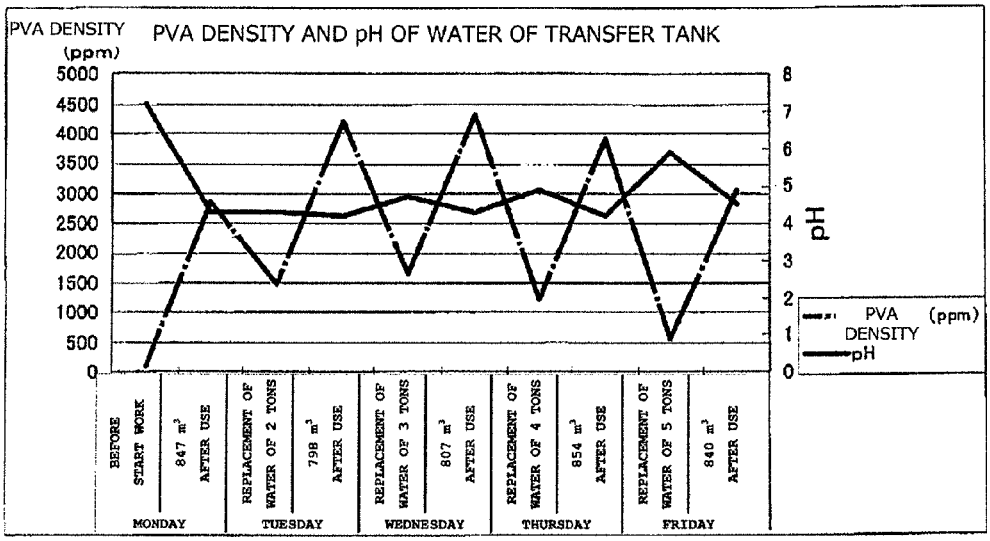

Fig.13
(a)
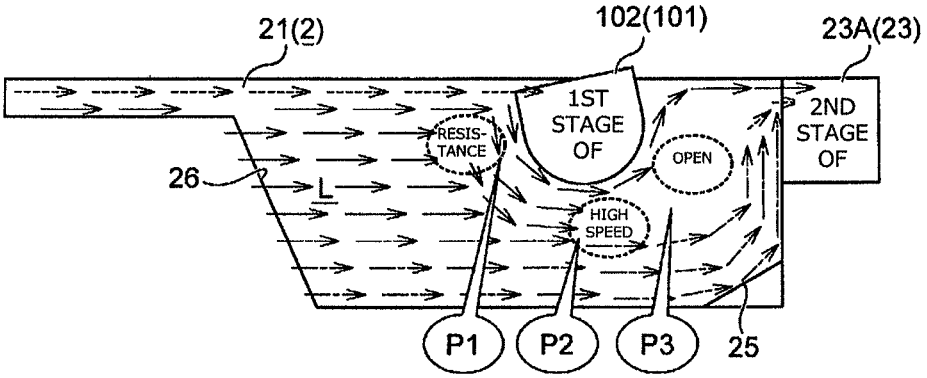
(b)
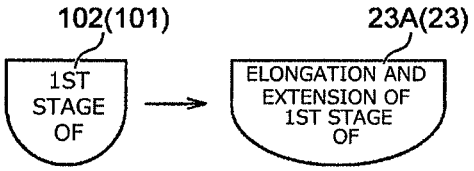

METHOD FOR LIQUID SURFACE ACTIVATION OF TRANSFER FILM, HYDROGRAPHIC METHOD AND HYDROGRAPHIC DEVICE IMPLEMENTING SAME

TECHNICAL FIELD

The present invention relates to a liquid pressure transfer (water pressure transfer) in which a transfer film made by applying an appropriate transfer pattern (surface ink layer) with a transfer ink in advance is supported in a floating manner on the surface of the transfer liquid (on the surface of the water) and an object is put into the transfer liquid (water) by being pressed, whereby the transfer pattern formed on the film is transferred onto the object using the liquid pressure thereof. The present invention relates to a new activation method and a new liquid pressure transfer technique, which are on the premise that the transfer film is supplied to the liquid surface and then is activated when ink of the transfer pattern or a hardening resin layer is activated, capable of continuously performing a precise transfer.

BACKGROUND ART

The liquid pressure transfer is a technique for transferring a transfer pattern formed on a transfer film to the surface of an object using liquid pressure by sequentially supplying the transfer film formed by applying a predetermined water-insoluble transfer pattern or a hardening resin layer, for example, on a water-soluble film (a support sheet) to the transfer liquid disposed inside a transfer tank to float and dipping the object into the inside of the transfer tank while being brought into contact with the transfer film. In the transfer film, as described above, the transfer pattern is formed (printed) on the water-soluble film in advance by using ink, and the ink of the transfer pattern is in the dry state. Accordingly, when the transfer is performed, it is necessary to return the transfer pattern to a wet state as that right after a printing process, in other words, a state in which the adhesiveness is developed by coating the transfer pattern formed on the transfer film with an activating agent or thinner, which is called activation.

Here, as a general technique for activating a transfer film, an activating agent coating technique using a gravure roll coater, a kiss-touch roll coater, or a spray nozzle (spray gun) is known. Among these, the gravure roll coater and the kiss-touch roll coater are used for activating ink before the transfer film is introduced (supply) into the inside of the transfer tank. On the other hand, the spray gun is used for activating ink on the liquid surface in the state in which the transfer film floats on the liquid surface inside the transfer tank, in other words, after the transfer film is introduced into the inside of the transfer tank. Hereinafter, defects (problems) of each technique will be described.

First, according to the activating agent coating technique using the gravure roll coater, there is a problem in that cell grains (unevenness) of gravure appear in a decorative layer of a transfer product to degrade the quality of the decorative layer. On the other hand, according to the kiss-touch roll coater, while the cell grains of the gravure roll can be resolved, there is a defect of being a higher-price device. In addition, according to all such techniques using the coaters, since the transfer film is activated (coating using the activating agent is performed) before floating on the liquid surface inside the transfer tank, the film absorbs the liquid right after a liquid contact, and the expansion and the contraction thereof occur in a short time. Accordingly, a guide mechanism (guide chain) that regulates the swelling width of the film is used, and it is necessary to prevent the generation of wrinkles by causing the wind to blow toward the film surface using a blower while supplying air bubbles from the lower side of the film, and it is necessary to additionally install a wind shield or a wave dissipation device so as to alleviate the influence of a wind generated by the wind of the blower and waves on the water surface, whereby a transfer device is high priced.

Meanwhile, according to the activating agent coating technique using the spray gun, in other words, the technique for activating a transfer film after causing the transfer film, in which the transfer pattern is still in the dry state, to float inside the transfer tank, even when a water-soluble film tends to contain water to swell up in accordance with the liquid contact, ink that is in the dry state acts to suppress the swelling and the expanding of the transfer film, and accordingly, the transfer film does not swell up and expand that much also after the liquid contact. Furthermore, according to this technique, the transfer pattern is coated with the activating agent from the spray gun in such a state of the film, and accordingly, the generation of cell grains according to the gravure roll coater does not occur. In addition, the regulation of the swelling and the expanding according to the dry ink is released right after the coating using the activating agent, and the transfer film is broadened up to the guide chain width and is in the state of wet ink that is suitable for the transfer.

As the spray system of the activating agent, there is a low-pressure atomization system on the upper side of the film, a self-weight setting type activation system (see Patent Literature 1) in which fine fog drips are generated inside a hood, an electrostatic spray coating system (see Patent Literature 2) in which a high coating efficiency is proposed, or the like. However, according to the technique using the spray gun, as described above, since ink that is in the dry state acts to suppress the swelling and the expanding of the transfer film, the transfer film does not swell up or expand that much even after the liquid contact. Thus, according to this technique, the transfer film before the activation is conveyed in a floating manner in a non-regulated state in which both sides thereof are not guided, and the transfer film is coated (activated) with the activating agent in this state.

Even when a guide chain holding both sides of the transfer film before the activation is arranged, apparently, it cannot be determined that the transfer film is reliably held by the guide chain. The reason for this is that, as described above, only the water-soluble film disposed on the lower side out of the transfer films tends to swell up according to the liquid contact, and accordingly, both end portions of the film tend to upwardly curl due to a difference in growth from the ink layer disposed on the upper side as a whole (tending to curl so as to float from the water surface).

In addition, in a case where an activating agent component floats and stays on the liquid surface between the transfer film and the guide chain, this activating agent component acts to hinder the elongation/expansion of the transfer film, and accordingly, it becomes more difficult for the transfer film to be in contact with the guide chain.

Accordingly, the occurrence of a case is extremely rare in which the transfer film before the activation travels at the center of the guide chain and elongates/expands uniformly to the right and left sides after the activation. Generally, the transfer film is activated normally in the state of approaching or being brought into contact with one of the right and left guide chains so as to elongate/expand. Accordingly, the transfer film after the activation has an elongation rate that is different on the right and left sides, or bending of the transfer pattern occurs, whereby there is a problem in that the transfer film goes on the guide chain so as to be non-transferable or the like.

In addition, when the activating agent component floats and stays near the side wall of the transfer tank, the elongation/expansion of the film is hindered, and accordingly, there is a problem in that a position appropriate for the transfer changes or the like.

Furthermore, even in a case where the activating agent inside the hood is discharged to an exhaust duct in order to maintain an operation environment appropriately, there are a problem in that a deodorizing device separating and collecting the activating agent component from the exhaust gas or eliminating a bad smell is high priced, a problem in that there is no economic advantage of the readjustment of the activating agent component due to an extremely small amount of the activating agent component that is separated and collected, and the like.

In addition, a remaining film that has not been transferred to the object is collected and resolved in an overflow unit that is disposed on the downstream of the transfer tank so as to precipitate a solid content such as ink, and the collected liquid (transfer liquid) that is cleaned as above has the temperature being adjusted and then is circulated and reused in the upstream part of the transfer tank. This is almost the same configuration in both a continuous-type transfer system and a batch-type transfer system.

Here, when the transfer liquid is close to fresh water, and the density of the water-soluble film (for example, PVA: polyvinyl alcohol) is 500 ppm or less, the transfer film is hard, and the attachment and circulating property deteriorates, whereby a defective transfer may easily occur. However, when the density of the water-soluble film rises to about 3000 ppm or more in accordance with the continuation of the liquid pressure transfer, the transfer film is softened too much this time, and there is a problem in that a defective transfer may easily occur.

In addition, while the object after the transfer is dried after the water-soluble film is cleaned and rinsed by using a film detachment cleaning device, generally, the discharged cleaning water is discharged as waste water after a water discharge treatment or is reused as industrial water after an advanced treatment.

CITATION LIST

Patent Literature

Patent Literature 1: Japanese Patent Application Laid-Open (JP-A) No. 7-76067

Patent Literature 2: JP-A No. 2005-81619

SUMMARY OF INVENTION

Technical Problem

The present invention is contrived in consideration of such a background and is for developing a new method for activating a transfer film capable of suppressing horizontally unbalanced elongation/expansion of a transfer pattern as described above, capable of uniformly and effectively coating the transfer pattern of the transfer film with an activating agent in a short time, and continuously performing precise transfer on the premise that the transfer film is activated on the surface of the transfer liquid and a liquid pressure transfer technique implementing the method for activating a transfer film.

Solution to Problem

First, according to claim 1, there is provided a method for activating a transfer film in which a transfer film formed by forming at least a transfer pattern in a dry state in a water-soluble film is supplied to a liquid surface inside a transfer tank in a state in which the transfer pattern faces the upper side, and then, the transfer pattern formed on the transfer film is activated by applying an activating agent from the upper side of the transfer film. In the transfer tank, a pre-activation guide mechanism holding both sides of the transfer film at horizontally equivalent positions from the transfer film supplied to the liquid surface disposed at the center of the transfer tank and guiding the transfer film to an activation area is disposed, and swelling of the transfer film is urged in the thickness direction while the transfer film is held by the pre-activation guide mechanism, and, in the activation area, the transfer film is coated with the activating agent in a state in which the guiding action of the transfer film according to the pre-activation guide mechanism is cancelled.

According to claim 2, there is provided a method for activating a transfer film under the conditions described in claim 1, wherein, in the activation of the transfer film in the activation area, the elongation and expansion suppression state of ink that is in the dry state is canceled at once, and the transfer film is caused to swell to be horizontally equivalent without any distortion in the widthwise direction by urging the transfer film before activation to swell in the thickness direction using the pre-activation guide mechanism, releasing the holding of both sides of the transfer film according to the pre-activation guide mechanism right before the activation area, and coating the transfer film with the activating agent in this state.

According to claim 3, there is provided a method for activating a transfer film under the conditions described in claim 1 or 2, wherein, in a later stage of the activation area, a post-activation guide mechanism that holds both sides of the transfer film elongating and expanding in the widthwise direction according to the activation at horizontally equivalent positions from the center of the transfer tank and guiding the transfer film to a transfer area is disposed.

According to claim 4, there is provided a method for activating a transfer film under the conditions described in claim 1, 2, or 3, wherein, in coating the transfer film disposed on the surface of a transfer liquid with the activating agent in the activation area, a spray gun spraying the activating agent applies the activating agent up to the outside of the both sides of the transfer film while reciprocating in the widthwise direction of the transfer film, and, a removing means is disposed in outer portions of the both sides of the transfer film in the activation area, the removing means discharges an unnecessary activating agent component that has been applied to the film on the surface of the transfer liquid and floats on the liquid surface together with the transfer liquid, and the removing means also sucks the activating agent floating and scattering inside a hood covering the activation area at the same time and discharges the activating agent together with the transfer liquid in a mixed manner.

According to claim 5, there is provided a method for activating a transfer film under the conditions described in claim 4, wherein, in a position right before a contact of the transfer film elongating and expanding in the widthwise direction in accordance with the activation with the post-activation guide mechanism, a removing means for sending an activating agent component floating between the post-activation guide mechanism and the transfer film on the surface of the transfer liquid to a portion to which the unnecessary activating agent component on both sides of the activation area is discharged together with the transfer liquid or to a place between a side wall of the transfer tank and the post-activation guide mechanism is disposed.

According to claim 6, there is provided a method for activating a transfer film under the conditions described in claim 1, 2, 3, 4, or 5, wherein, in supplying the transfer film to the surface of the transfer liquid, on a previous stage of the supply of the transfer film to the transfer tank, curl preventing projections and depressions resisting against a curl having a stripe pattern in the widthwise direction of the transfer film are formed in portions of the both sides of the transfer film.

In addition, according to 7, there is provided a liquid pressure transfer method in which a transfer film formed by forming at least a transfer pattern on a water-soluble film in a dry state is supported to float on a liquid surface inside a transfer tank, an object is pressed from the upper side, and the transfer pattern is transferred mainly to a design surface side of the object in accordance with liquid pressure generated by pressing the object, wherein, in activating the transfer film, the transfer film is activated using an activation method according to claim 1, 2, 3, 4, 5, or 6.

According to claim 8, there is provided a liquid pressure transfer method under the conditions described in claim 7, wherein an overflow unit is disposed on the downstream side of the transfer tank, foreign substances such as a remaining film and the like are deposited and removed from a liquid collected by the overflow unit, the temperature of the collected liquid is adjusted, and then, the collected liquid is cyclically supplied from the upstream side of the transfer tank, and the object pulled up from the transfer tank is then sent to a film detachment cleaning process, the water-soluble film of the surface is dissolved and cleaned in the film detachment cleaning process, and discharged cleaning water containing the dissolved water-soluble film that is generated in the process is cyclically supplied to a position right before the overflow unit of the transfer tank.

According to claim 9, there is provided a liquid pressure transfer method under the conditions described in claim 7 or 8, wherein, in the transfer tank, in a liquid-leaving area in which the object is pulled up from the transfer liquid, a design surface oppositely-separating flow that flows away from the design surface of the object getting out of the liquid is formed, and bubbles disposed on the surface of the transfer liquid and foreign substances staying in the liquid are placed far from the design surface of the object getting out of the liquid and are discharged to the outside of the transfer tank.

According to claim 10, there is provided a liquid pressure transfer method under the conditions described in claim 9, wherein, in a previous stage of the overflow unit, an overflow tank facing the design surface of the object getting out of the liquid is further disposed, and the design surface oppositely-separating flow is formed by the overflow tank.

According to claim 11, there is provided a liquid pressure transfer device including: a transfer tank that stores a transfer liquid; a transfer film supply device that supplies a transfer film to the transfer tank; an activating agent apply device that coats the transfer film supplied to the liquid surface of the transfer tank with an activating agent to be in a transferable state; and an object conveying device that presses an object to the transfer film that is in an activated state on the liquid surface of the transfer tank by the activating agent from the upper side. The transfer film formed by forming at least a transfer pattern in a water-soluble film in a dry state is supported to float on the liquid surface inside the transfer tank, and the transfer pattern is transferred to mainly the design surface of the object in accordance with liquid pressure generated by pressing the object from the upper side, in the transfer tank, a pre-activation guide mechanism holding both sides of the transfer film at horizontally equivalent positions from the transfer film supplied to a liquid surface disposed at the center of the transfer tank and guiding the transfer film to an activation area is disposed, and swelling of the transfer film is urged in the thickness direction while the transfer film is held by the pre-activation guide mechanism, and, in the activation area, the transfer film is coated with the activating agent in a state in which the guiding action of the transfer film according to the pre-activation guide mechanism is cancelled.

According to claim 12, there is provided a liquid pressure transfer device under the conditions described in claim 11, wherein, in a later stage of the activation area, a post-activation guide mechanism that holds both sides of the transfer film elongating and expanding in the widthwise direction according to the activation at horizontally equivalent positions from the center of the transfer tank and guiding the transfer film to a transfer area is disposed.

According to claim 13, there is provided a liquid pressure transfer device under the conditions described in claim 11 or 12, wherein the activating agent apply device includes a spray gun that sprays the activating agent, and the spray gun applies the activating agent up to the outer sides of the both sides of the transfer film while reciprocating in the widthwise direction of the transfer film in the activation area, and, a removing means is disposed in outer portions of the both sides of the transfer film in the activation area, the removing means discharges unnecessary activating agent component that has been applied to the film on the surface of the transfer liquid and floats on the liquid surface together with the transfer liquid, and the removing means also sucks the activating agent floating and scattering inside a hood covering the activation area at the same time and discharges the activating agent together with the transfer liquid in a mixed manner.

According to claim 14, there is provided a liquid pressure transfer device under the conditions described in claim 13, wherein, on both sides of the activation area, in a suction port of the removing means discharging and collecting the unnecessary activating agent component together with the transfer liquid, fillers promoting an air-liquid contact between the air containing the unnecessary activating agent component and the collected liquid are disposed, a mist separator in which fillers promoting an air-liquid contact between the air containing the unnecessary activating agent component and the collected liquid, and a demister are built is disposed on a later stage of the water discharge side of the collected liquid of the removing means, and an air discharge fan is disposed on a further later stage, and the air containing the unnecessary activating agent component is discharged from the air discharge fan to the outside after cleaning the air by causing the activating agent component to be dissolved into the collected liquid according to such a configuration.

According to claim 15, there is provided a liquid pressure transfer device under the conditions described in claim 13 or 14, wherein, in a position right before a contact of the transfer film elongating and expanding in the widthwise direction in accordance with the activation with the post-activation guide mechanism, a removing means for sending an activating agent component floating between the post-activation guide mechanism and the transfer film on the surface of the transfer liquid to a portion to which the unnecessary activating agent component on both sides of the activation area is discharged together with the transfer liquid or to a place between a side wall of the transfer tank and the post-activation guide mechanism.

According to claim 16, there is provided a liquid pressure transfer device under the conditions described in claim 11, 12, 13, 14, or 15, wherein the transfer film supply device includes a projection/depression molding roller that forms projections and depressions having a stripe pattern for preventing a curl that resist against a curl in the widthwise direction of the film or a laser marker that forms projections and depressions for preventing a curl as fine projections and depressions in portions of the both sides of the transfer film before the supply to the transfer tank.

According to claim 17, there is provided a liquid pressure transfer device under the conditions described in claim 11, 12, 13, 14, 15, or 16, wherein the pre-activation guide mechanism is configured by a conveyer formed by winding an endless belt around a pulley, and a rotation axis of the pulley is set to an approximately vertical direction, and the widthwise direction of the wound belt is set to the height direction of the surface of the transfer liquid.

According to claim 18, there is provided a liquid pressure transfer device under the conditions described in claim 12, 13, 14, 15, 16, or 17, wherein the post-activation guide mechanism is handled even after the transfer area such that a guide member holding the both sides of the transfer film in the pre-activation guide mechanism avoids the activation area, and the both sides of the transfer film elongating and expanding according to the activation are held by the guide member that is the same as the pre-activation guide mechanism.

According to claim 19, there is provided a liquid pressure transfer device under the conditions described in claim 11, 12, 13, 14, 15, 16, 17, or 18, wherein an overflow unit is disposed on the downstream side of the transfer tank, foreign substances such as a remaining film and the like are deposited and removed from a liquid collected by the overflow unit, the temperature of the collected liquid is adjusted, and then, the collected liquid is cyclically supplied from the upstream side of the transfer tank using a circulating pipe path, a film detachment cleaning device that cleans the surface of the object pulled up from the transfer tank is included in a later stage of the transfer tank, and the water-soluble film attached to the surface of the object is dissolved to be cleaned and removed by the film detachment cleaning device, this film detachment cleaning device is formed by being connected to the transfer tank using a circulating water discharge pipe path, and discharged cleaning water containing the dissolved water-soluble film that is generated in the film detachment cleaning process is cyclically supplied to a position right before the overflow unit of the transfer tank.

According to claim 20, there is provided a liquid pressure transfer device under the conditions described in claim 11, 12, 13, 14, 15, 16, 17, 18, or 19, wherein, in a liquid-leaving area in which the object is pulled up from the transfer liquid, an oppositely-separating flow forming means that acts on the design surface of the object floating from the transfer liquid is disposed, a design surface oppositely-separating flow that flows away from the design surface of the object getting out of the liquid is formed, and bubbles disposed on the surface of the transfer liquid and foreign substances staying in the liquid are placed far from the design surface of the object getting out of the liquid and are discharged to the outside of the transfer tank in accordance with the design surface oppositely-separating flow.

According to claim 21, there is provided a liquid pressure transfer device under the conditions described in claim 20, wherein, in a previous stage of the overflow unit, an overflow tank facing the design surface of the object getting out of the liquid is further disposed, and the design surface oppositely-separating flow is formed by the overflow tank.

Advantageous Effects of Invention

The above-described problems are solved by means of the configuration described in each claim.

First, according to the invention described in claim 1, 7, or 11, since the transfer film is sent to the activation area while both sides thereof are held by the pre-activation guide mechanism before activation, and accordingly, the occurrence of a deviation, position mismatch, meandering, or the like in the transfer film before activation can be prevented. In addition, in the transfer film having both sides being held (regulated) by the pre-activation guide mechanism, particularly, the water-soluble film carrying the transfer pattern is urged to swell up in the thickness direction, the elongation and expansion suppression state of ink that is in the dry state is released at once by applying the activating agent that is performed thereafter, and the preparation (posture) for swelling in the widthwise direction is arranged. In other words, the transfer pattern (ink) tends to elongate and expand equally according to activation at one stretch, and accordingly, it is necessary to cause the water-soluble film to be soften (swell up) to the degree for following up the growth of the transfer pattern. Thus, in the present invention, this can be realized by promoting swelling in the thickness direction using the pre-activation guide mechanism.

In addition, the device that has high spraying efficiency of the activating agent, enhanced operation environment, and reduced initial cost and running cost can be realized, whereby the mass productivity thereof can be improved.

According to the invention described in claim 2 or 7, the transfer film is in the state of sufficiently swelling up in the thickness direction until it arrives at the activation area. In addition, at the time of activation, the transfer film is coated with the activating agent in the state in which the holding of both sides is released. Accordingly, the elongation and expansion suppression state of ink that is in the dry state is released at once, and the transfer film can be elongated and expanded equally to the right and left sides in the widthwise direction without any distortion.

According to the invention described in claim 3, 7, or 12, the transfer film supplied to the surface of the transfer liquid, first, is held and conveyed at the center portion of the transfer tank by the pre-activation guide mechanism, then the holding is released in the activation area, and the transfer film is activated at the center portion of the transfer tank (the activating agent is applied), swells up equally to the right and left sides in the widthwise direction, and thereafter, is held and conveyed by the post-activation guide mechanism. In other words, a control process such as a position deviation prevention process or a deviation prevention process is performed for the transfer film over two stages with the activation area interposed therebetween. Accordingly, while the transfer film is activated in the state in which the holding of both sides of the film is released in the activation area, even after the activation, the transfer film is sent to the transfer area at a desired position and a desired degree of elongation and expansion (it is supplied to the transfer area in the state in which the film is approximately equally elongated and expanded in the widthwise direction). Therefore, even when consecutive transfers are repeated, precise transfers can be continuously performed.

According to the invention described in claim 4, 7, or 13, since the activating agent is applied up to the outer sides of both sides of the transfer film, the transfer film can be elongated and expanded equally to the right and left sides (in the widthwise direction). In addition, on both sides of the activation area, the removing means is disposed which discharges an unnecessary activating component disposed on the surface of the transfer liquid together with the transfer liquid and sucks an activating agent floating and scattering inside the hood covering the activation area at the same time and mixes and discharges the activating agent with the transfer liquid. Accordingly, the reduction of elongation and expansion of the transfer film can be reliably prevented, and the transfer film after activation can be brought into contact with (held in) the post-activation guide mechanism in a stable manner.

According to the invention described in claim 5, 7, or 15, in order to send an activating agent staying and floating at a position right before the contact of the transfer film with the post-activation guide mechanism between the post-activation guide mechanism (the rear side of the guide) and the transfer tank or the like by the removing means. Accordingly, the reduction of elongation and expansion of the transfer film after activation can be prevented, and the transfer film after activation can be brought into contact with (held in) the post-activation guide mechanism in a stable manner.

According to the invention described in claim 6, 7, or 16, in portions of both sides of the transfer film before the supply, since projections and depressions, which have a stripe shape, used for preventing a curl are formed, a curl phenomenon occurring in the transfer film after a liquid contact can be prevented. In addition, the transfer film can be brought into contact with the pre-activation guide mechanism in a stable manner, and accordingly, the transfer film can be reliably held. Furthermore, since the effective use width of the film can be broadened, the elongation rate in the widthwise direction can be suppressed, and the pattern growth feeling can be relieved, whereby a high-precision transfer design can be represented.

According to the invention described in claim 8 or 19, discharged water (discharged cleaning water containing a dissolved water-soluble film) from the film detachment cleaning process is drawn to the transfer tank and is cyclically used, and the water-soluble film cleaned in this process is deposited and collected in the overflow unit of the transfer tank as well. Accordingly, the density of the water-soluble film of the transfer tank enters a predetermined range, whereby the transfer performance can be stabilized, and the replacement of the transfer liquid may be hardly necessary.

According to the invention described in claim 9 or 20, for an object getting out of the liquid, a design surface oppositely-separating flow is formed in a direction separating away from a design surface, and accordingly, it is difficult for foreign substances such as bubbles and film scraps to adhere to the design surface, and a clean transfer product (object) can be acquired. In addition, since it is difficult for the bubbles and the foreign substances to adhere to the design surface, a transfer pattern can be accurately transferred, and it is difficult for pattern distortion or deformation to occur.

In addition, according to the invention described in claim 10 or 21, in the terminal end portion of the transfer tank, on the previous stage of the overflow unit (second-stage OF tank) that collects film scraps and the like together with the transfer liquid, an overflow tank (first-stage OF tank) used for forming a design surface oppositely-separating flow is additionally disposed so as to employ a two-stage overflow structure, and accordingly, the flow of the liquid inside the transfer tank can be controlled as below. First, since the first-stage OF tank becomes resistance for a liquid flow, a middle layer stream at a height (depth) at which the first-stage OF tank is approximately arranged becomes a flow slipping through the lower side of the OF tank. In other words, the middle layer stream becomes a downward flow getting into the lower side of the OF tank right before the first-stage OF tank and becomes an upward flow after passing through the first-stage OF tank. On the other hand, an upper layer stream (a surface stream inside the transfer tank) flowing through a position (liquid level) higher than that of the middle layer stream is directly collected by the first-stage OF tank. In addition, a lower layer stream (a liquid flow flowing through the bottom of the transfer tank) flowing through a position lower than that of the middle layer stream directly flows horizontally regardless of the first-stage OF tank, and a curtain effect occurs in which it is difficult to cause foreign substances contained in the middle layer stream to be deposited and stay at the bottom of the transfer tank. In addition, after passing through the first-stage OF tank, the middle layer stream becomes an upward flow, and accordingly, the lower layer stream is pulled upward, and foreign substances considered to be contained much particularly in the lower face of the middle layer stream in the transfer liquid in accordance with the upward flows according to the middle layer stream and the lower layer stream are sent to the second-stage OF tank and can be efficiently collected therein.

According to the invention described in claim 14, since the air containing an unnecessary activating agent component is sufficiently dissolved into the collected liquid (transfer liquid) and is processed, the air containing the activating agent (solvent) can be purified in an easy manner at low cost. In addition, the scattering of a solvent mist in the transfer room can be nearly prevented. In addition, generally, the collected liquid in which the air containing the unnecessary activating agent component has been dissolved is sent to a sewage system, a waste water treatment tank, or the like.

According to the invention described in claim 17, in the pre-activation guide mechanism, the rotation shaft of the pulley is set to the approximately vertical direction, and the widthwise direction of the belt wound around the pulley is set so as to be in correspondence with the depth (height) of the surface of the transfer liquid. Thus, for example, even when the liquid level inside the transfer tank changes while the transfer is repeatedly performed, the change can be responded using the width size of the belt, and the liquid pressure transfer can be efficiently performed without adjusting the height of the entire conveyer.

According to the invention described in claim 18, since a guide member holding both sides of the film is used to be common to the pre-activation guide mechanism and the post-activation guide mechanism, the transfer film can be sent at the same speed before and after the activation. Accordingly, in a case where the transfer is desired to be performed while the film speeds in the activation area and the transfer area match each other, the transfer can be efficiently performed.

BRIEF DESCRIPTION OF DRAWINGS

FIG. 6 represents an explanatory diagram (side view) (a) that illustrates another embodiment of a projection/depression molding roller forming projections and depressions for preventing a curl in a transfer film, an explanatory view (side view) (b) that illustrates a further another embodiment in which projections and depressions for preventing a curl are formed by using a laser marker, and an explanatory diagram (cross-sectional view) (c) that illustrates the appearance in which curl preventing projections and depressions are formed as unevenness having a key pattern that is seen from the side face.

FIG. 8 is a perspective view that illustrates an embodiment in which the width size (guide width size) used for holding and regulating both sides of a transfer film can be appropriately changed in a pre-activation guide mechanism and a post-activation guide mechanism.

FIG. 9 represents a table that illustrates changes in the weekly transfer amount, the amount of exchanged water of transfer water, and the PVA density and a graph that illustrates the relation between the PVA density and PH of transfer tank water at that time according to the conventional liquid pressure transfer method.

FIG. 13 is an explanatory diagram that schematically illustrates the appearance of the liquid flow inside a transfer tank in a two-stage OF structure in which an overflow tank (first-stage OF tank) is arranged in addition to the previous stage of an overflow unit (second-stage OF tank) that collects film scraps and the like together with a transfer liquid.

REFERENCE SINGS LIST

Figure 1:
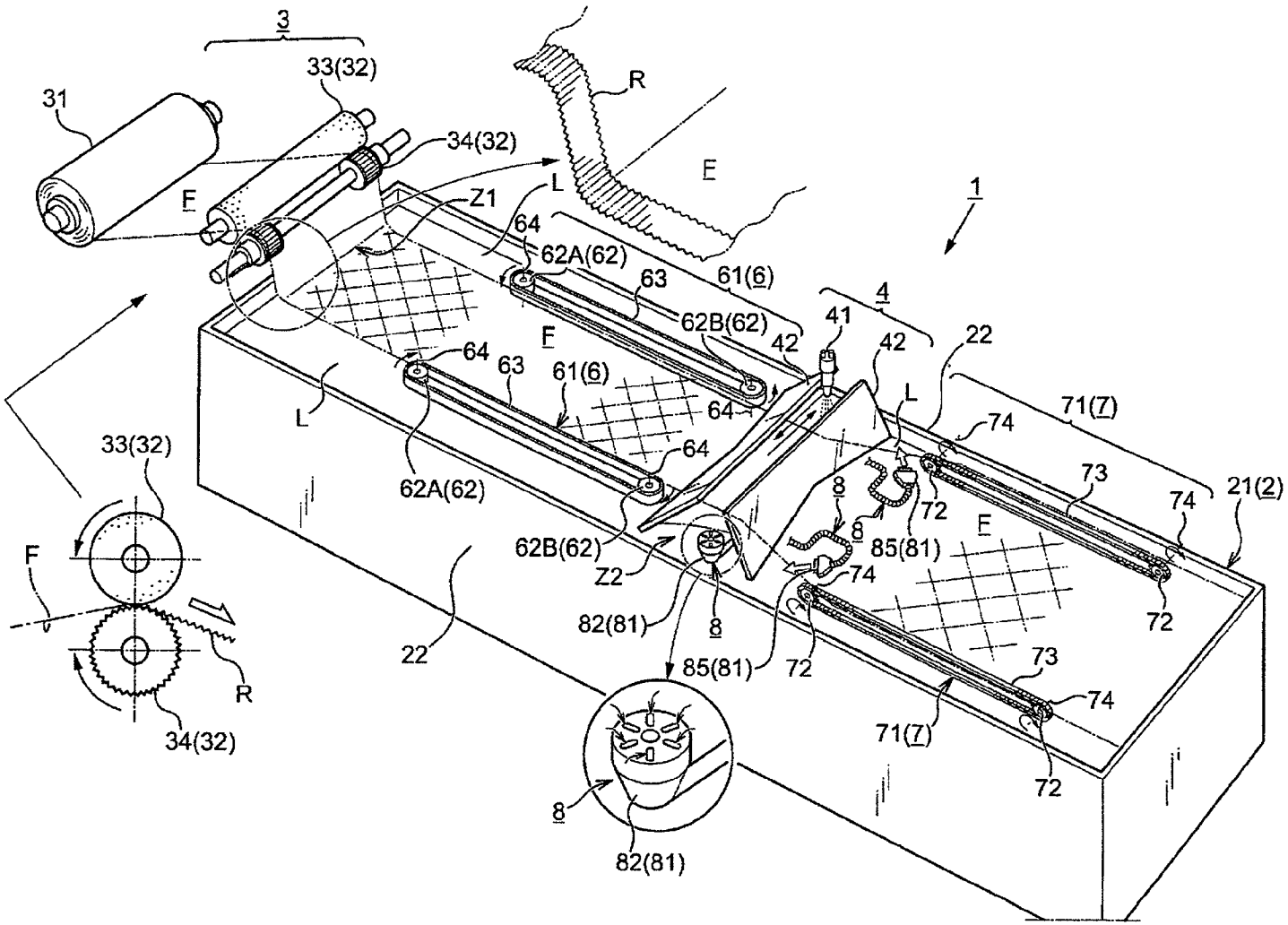
FIG. 1 is a perspective view that illustrates an example of a liquid pressure transfer device according to the present invention.

1 liquid pressure transfer device
2 transfer tank
3 transfer film supply device
4 activating agent apply device
5 object conveying device
6 pre-activation guide mechanism
7 post-activation guide mechanism
8 elongation and expansion reduction prevention mechanism
9 film detachment cleaning device
10 design surface cleaning mechanism
2 transfer tank
21 processing tank
22 side wall
23 overflow unit
23A overflow tank (second-stage OF tank)
24 circulating pipe path
25 inclined plate
26 inclined part
3 transfer film supply device
31 film roll
32 projection/depression molding roller
33 rubber smoothing roller
34 serration roller
35 gear (wave-shaped teeth)
36 gear (wave-shaped teeth)
37 laser marker
4 activating agent apply device
41 spray gun
42 hood
5 object conveying device
51 conveyer
52 jig (transfer jig)
53 link chain
6 pre-activation guide mechanism
61 conveyer
62 pulley
62A driving pulley
62B driven pulley
63 belt
64 rotary shaft
65 arm bar
66 clamp
7 post-activation guide mechanism
71 chain conveyer
72 sprocket
73 chain
74 rotary shaft
8 elongation and expansion reduction prevention mechanism
81 removing means
82 catch basin
83 mist separator
84 air discharge fan
85 compressed air blow nozzle

9 film detachment cleaning device
91 conveyer
92 warm water shower
92*a* supply pipe path
93 rinse water shower
93*a* supply pipe path
94 storage tank
95 circulating water discharge pipe path
10 design surface cleaning mechanism
101 oppositely-separating flow forming means
102 overflow tank (first-stage OF tank)
103 discharge port
104 flow rate increase brim
105 sucking nozzle
F transfer film
L transfer liquid
W object
R curl preventing projection and depression
S1 design surface
Z1 liquid contact point
Z2 activation area
Z3 transfer area
Z4 liquid-leaving area

DESCRIPTION OF EMBODIMENTS

An embodiment of the present invention includes any one of the following embodiments and various techniques for modifying the embodiments within the technical scope.

In description presented below, first, a transfer film F that is used in the present invention will be described, then, the entire configuration of a liquid pressure transfer device 1 will be described, and thereafter, a method of activating the transfer film will be described while the operation of the liquid pressure transfer device is described.

Embodiment

As the transfer film F, while, generally, a film acquired by forming only a transfer pattern using transfer ink on a water-soluble film (for example, PVA; polyvinyl alcohol) used as a carrier sheet is used, a film in which a hardening resin layer is formed between a water-soluble film and a transfer pattern may be used as well. Here, the significance of the hardening resin layer will be described. In a general transfer, the general transfer film F is used, and, in such a case, after the transfer, an overcoat is formed on an object W, whereby the surface of the decorative layer is protected. In contrast to this, in a transfer using a transfer film F in which the hardening resin layer is formed, by emitting an activation energy ray such as an ultraviolet ray or an electronic ray to an object W after the transfer, the transfer pattern formed in the liquid pressure transfer is hardened so as to protect the surface, and accordingly, the formation of an overcoat may not be performed. In other words, the hardening resin layer has the function of a surface protection layer.

In addition, as the transfer pattern, there are various patterns such as a grain pattern, a metal (glaze) pattern, a stone pattern such as a marble pattern that resembles the surface of a stone, a fabric pattern that resembles a cloth shape or a fabric shape, a tiled pattern, a pattern acquired by accumulating bricks, a geometric pattern, and a pattern having an hologram effect, and a pattern acquired by appropriately combining such patterns may be used. Here, the geometric pattern includes not only a graphic but also a pattern in which a text and a photograph are provided.

Next, the liquid pressure transfer device 1 will be described. The liquid pressure transfer device 1, for example, as illustrated in FIGS. 1 to 3, is formed by including a transfer tank 2 storing the transfer liquid L, a transfer film supply device 3 supplying the transfer film F to the transfer tank 2, the activating agent applying device 4 activating the transfer film F supplied to the transfer tank 2 on the liquid surface to be in a transferable state, and an object conveying device 5 that inputs (immerses) an object W with an appropriate posture from the upper side of the transfer film F supported to float by the transfer tank 2 and gets (pulls up) the object out of the liquid.

In addition, the transfer tank 2 is formed by including an pre-activation guide mechanism 6 that holds both sides of the transfer film F coming into contact with the liquid and conveys the transfer film to an activation area Z2, a post-activation guide mechanism 7 that holds both sides of the transfer film F after being coated with the activating agent and conveys the transfer film to a transfer area Z3, and an elongation and extension reduction prevention mechanism 8 for preventing reduction of elongation and extension of the transfer film F by removing an activating agent component disposed on the surface of the transfer liquid.

Figure 2:
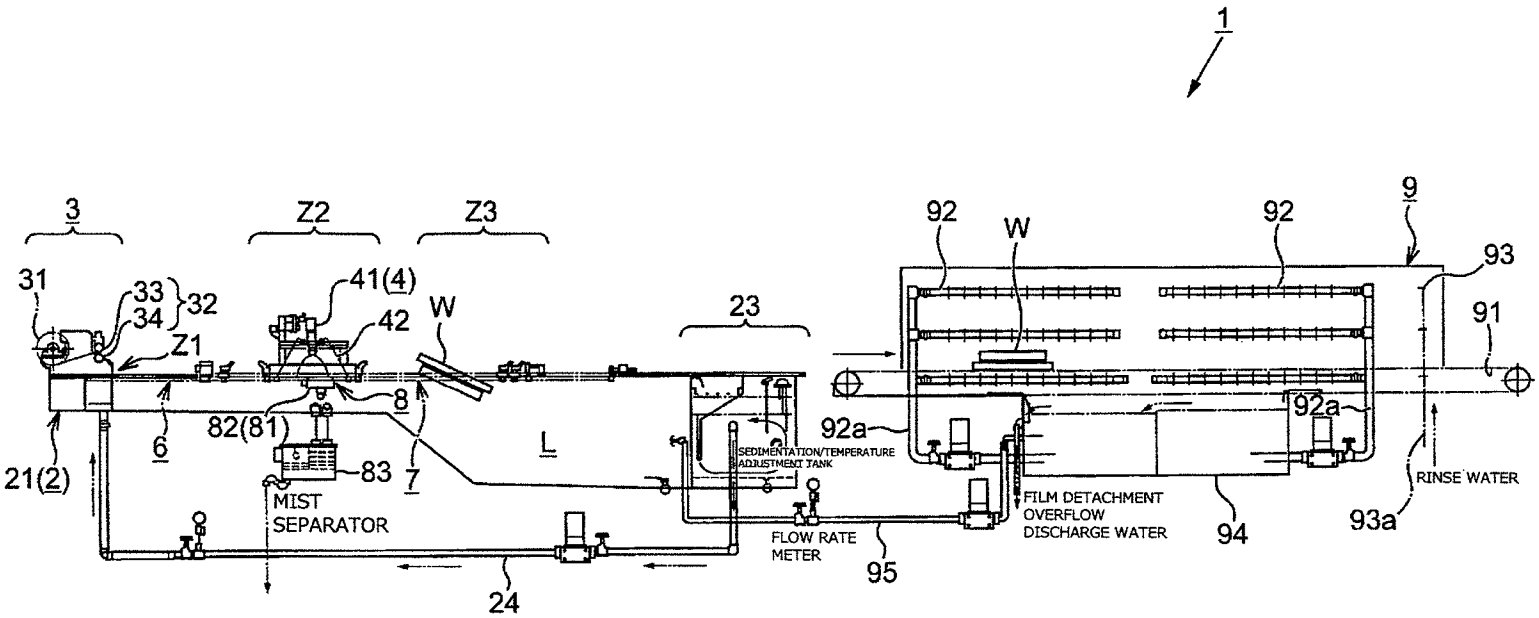
FIG. 2 is a side view that mainly illustrates a transfer tank and a film detachment cleaning device of the above-described liquid pressure transfer device.
Figure 3:
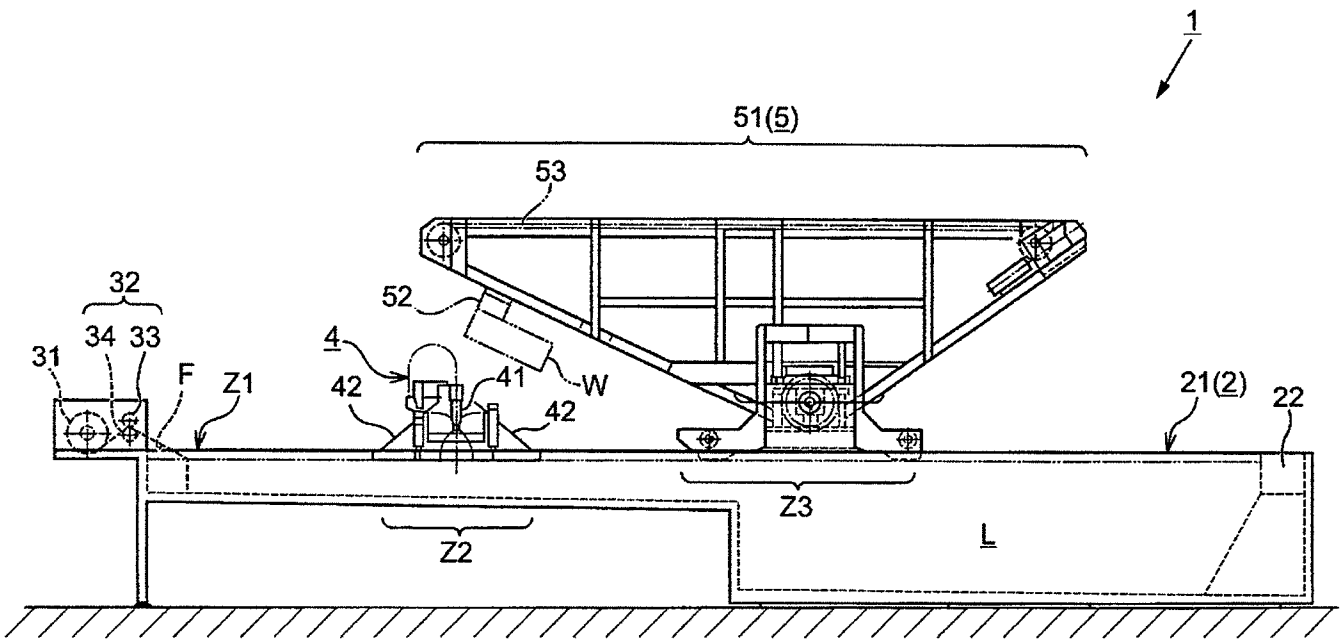
FIG. 3 is a side view that mainly illustrates an object conveying device of the above-described liquid pressure transfer device.

In addition, in the embodiment illustrated in FIG. 2, a film detaching and cleaning device 9 is further included in the rear stage of the transfer tank 2. This is responsible for a process of dissolving and cleaning a half-dissolved water-soluble film adhering to the surface of the object W at the time of performing a transfer.

Figure 10:
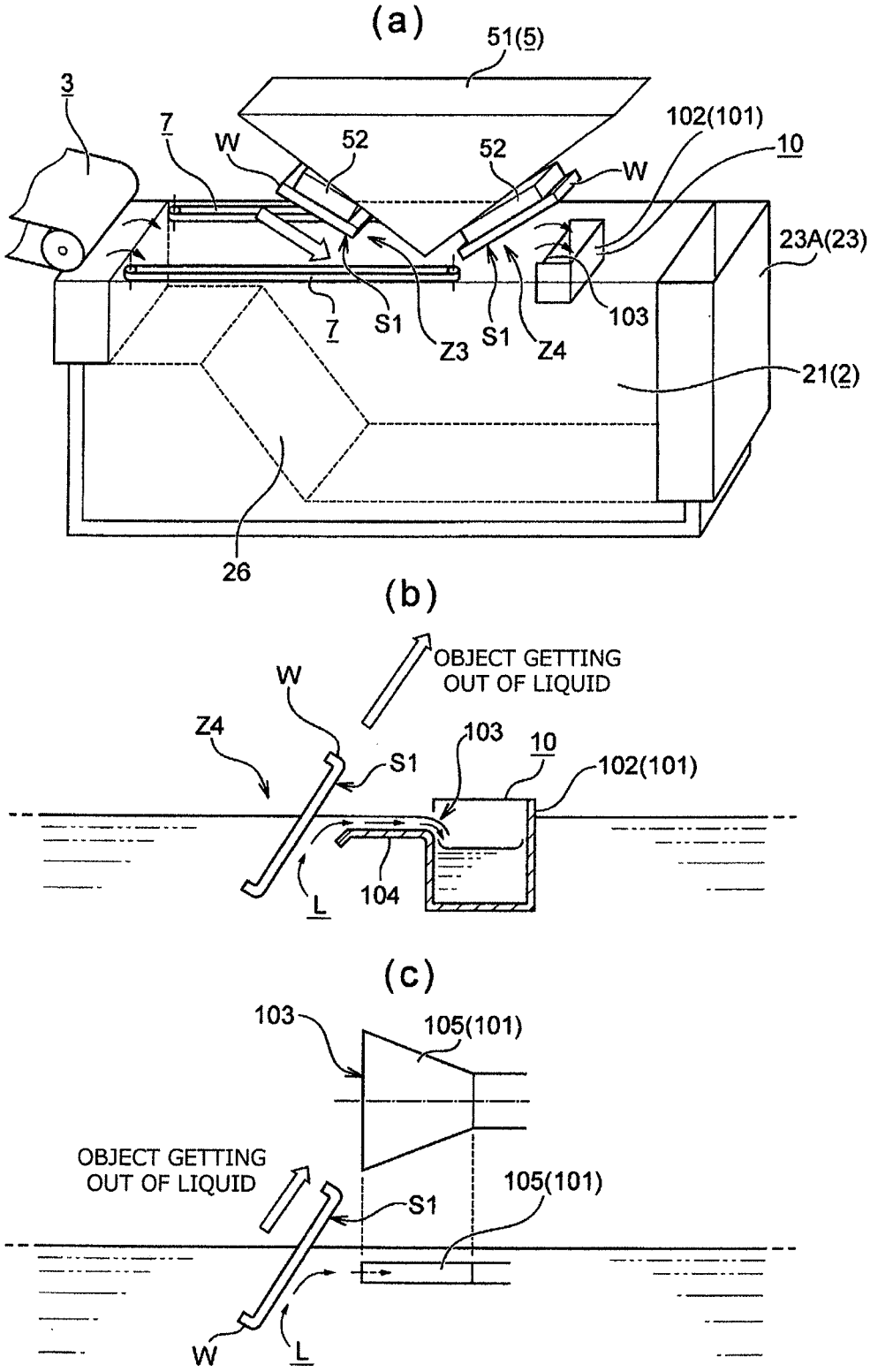
FIG. 10 represents a skeletal perspective view (a) that illustrates a transfer tank including a design surface cleaning mechanism together with a conveyer (triangular conveyer) as an object conveying device and explanatory diagrams (b) and (c) that illustrate the appearance of a design surface oppositely-separating flow acting on an object during leaving of the liquid in an enlarged scale.

In this specification, a point (area) at which the transfer film F comes into contact with the transfer liquid L disposed inside the transfer tank 2 is referred to as a liquid contact point Z1, an area that is applied with the activating agent is referred to as an activation area Z2, an area in which a transfer is performed is referred to as a transfer area Z3, and an area in which the object W after the transfer is pulled out of the transfer liquid L is referred to as a liquid-leaving area Z4 (see FIG. 10 for Z4). In addition, since a transfer is almost completed simultaneously with the immersion of the object W, the transfer area Z3 may also be referred to as an immersion area. In the present specification, while terms referred to as an "activating agent" and an "activating agent component" are used, mainly, the "activating agent component" refers to the name of an activating agent, with which the transfer film F or the surface of the transfer liquid has been coated, floating and staying on the surface of the transfer liquid so as to reduce the elongation and extension of the transfer film F. Hereinafter, each constituent unit will be explained.

First, before description of the transfer tank 2, a transfer film supply device 3 will be described. The transfer film supply device 3, for example, as illustrated in FIG. 1, is formed by including a film roll 31 that is formed by a roll-wound transfer film F and a projection and depression molding roller 32 that forms projections and depressions having a stripe pattern in both side portions of the film in the widthwise direction of the film when guiding the transfer film F pulled therefrom to the transfer tank 2. Here, the formation of the projections and depressions having a stripe pattern in the transfer film F is for preventing curls that may be generated on both sides of the film due to absorption of water in the water-soluble film after the transfer film F comes into contact with the liquid, and these projections and depressions are referred to as curl-prevention projections and depressions R. In other words, when being supplied to the transfer tank 2, the transfer film F is supplied (guided) to the surface of the transfer liquid in a state in which the curl-prevention projections and depressions R are formed with an approximately constant width dimension in both side portions.

In addition, for example, as illustrated together in FIG. 1, the projection and depression molding roller 32 is configured by a combination of a rubber smoothing roller 33 and a serration roller 34, which are installed in a circumscribed state, and thus, the curl-prevention projections and depressions R are formed as creases or stripes (strings) folded in the widthwise direction of the film.

Furthermore, in order to easily form the curl-prevention projections and depressions R on the transfer film F, the transfer film F may be heated in advance, and, for example, as one method therefor, there is a technique of building a heater in the serration roller 34.

Hereinafter, how (reason) the curl-prevention projections and depressions R prevent the curl phenomenon will be described. The curl-prevention projections and depressions R are bent lines (stripes) formed along the widthwise direction of the film, a film in which such stripes are simply formed are difficult to turn in the widthwise direction (the stripes has resilience or strength opposing bending), the bent lines (stripes) formed along the widthwise direction do not have strength resisting a curl, and it is considered to be significant that the curl-prevention projections and depressions R have height differences of a degree that is present in the vertical direction. In other words, for the curl-prevention projections and depressions R (stripes) having height differences, until all the projections and depressions come into contact with the liquid after they start to come into contact with the liquid from a portion disposed on the lower side, a time of some degree is required. In other words, there is a time difference between when the lowermost portion of the projections and the depressions starts to be immersed into the transfer liquid L and when the uppermost portion of the projections and the depressions is immersed, and an upper portion of the projections and depressions that has not come into contact with the liquid has strength resisting a curl in accordance with the time difference, and this is considered to serve for the prevention of a curl after the contact of the transfer film F with the liquid.

In addition, accordingly, in order to maintain the resilience, the curl-prevention projections and depressions R may be creases, and a slit shape in which the individual projections and depressions are completely cut out is not considered as being preferable. Furthermore, the combination of the rubber smoothing roller 33 and the serration roller 34 is a preferable configuration in this point (the point that individual projections and depressions are not completely cut out).

Furthermore, in a case where it is difficult to form curl-prevention projections and depressions R as described above on the film while the supply of the transfer film F is performed, in other words, while the transfer film F runs out or the like, as described above, first, after both side portions of the film are heated at the time of causing the transfer film to run out (after the film is formed to be easily deformed), the curl-prevention projections and depressions R can be formed by the projection and depression molding roller 32.

In addition, since resilience capable of resisting a curl may be included, the curl-prevention projections and depressions R do not need to be completely-bent lines (zigzag lines) when the film is seen from the side face and, for example, may have a wave shape (waveform) as illustrated in FIG. 6(*a*). In such a case, generally, the projection and depression molding roller 32, as illustrated together in FIG. 6(*a*), are configured by one pair of gears 35 and 36 having waveforms engaged with each other.

In addition, a means for forming the curl-prevention projections and depressions R is not necessarily limited to a contact-type projection and depression molding roller 32, and, for example, a non-contact type laser marker 37 as illustrated in FIG. 6(*b*) may be applied. In such a case, curl-prevention projections and depressions R that are more microscopic than those of the projection and depression molding roller 32 can be formed. It is to be understood that one laser marker 37 is provided on each one of both left and right sides of the transfer film F.

Furthermore, the curl-prevention projections and depressions R, for example, may be formed as projections and depressions having an angled zigzag shape (keyboard shape) as illustrated in FIG. 6(*c*) other than the bent line shape (zigzag shape) and the wave shape (waveform) when seen from the side face.

In addition, since the curl-prevention projections and depressions R may have resilience (strength) for a curl winding in the widthwise direction, the curl-prevention projections and depressions R do not necessarily need to be formed along the widthwise direction of the film but may be formed to be inclined with respect to the widthwise direction of the film.

In addition, in supplying the transfer film F to the transfer tank 2, in order to cause the transfer film F to reliably come into contact with the liquid and to maintain and stabilize the liquid contact point Z1 at a predetermined position, it is preferable to blow air (air over the widthwise direction) pressing the transfer film F to the side of the liquid surface at the liquid contact point Z1. In addition, in order to guide the transfer film F from the projection and depression molding roller 32 to the transfer tank 2 in a stable manner, it is preferable to provide an inclined guide such as a sliding board, and this does not necessarily need to be continuous in the widthwise direction of the film (the inclined guide may be partially provided in a non-continuous strip shape in the widthwise direction).

Next, the activating agent applying device 4 will be described. The activating agent applying device 4 activates the transfer film F in a transferable state, and, in the present invention, there is a distinctive feature in which the activating agent is applied in a state where the transfer film F is guided (supplied) to the surface of the transfer liquid, in other words, a state where the transfer film F floats on the liquid surface.

As a technique for applying the activating agent, for example, a technique utilizing electrostatic spray disclosed in U.S. Pat. No. 3,845,078 that has been issued to the applicants of this application may be applied. This technique, for example, as illustrated in FIG. 1, is a coating technique spraying an activating agent from a spray gun (spray nozzle) 41 for a transfer film F (transfer pattern) formed on the surface of the transfer liquid, and the spray gun 41 sprays the activating agent for the transfer film F conveyed on the surface of the transfer liquid while reciprocating so as to traverse this transfer film F (so called traverse). At that time, the activating agent is electrically charged at an exhaust nozzle of the spray gun 41, and the transfer film F floating on the surface of the transfer liquid is grounded through the transfer liquid L and a transfer tank 2, whereby the transfer film F is uniformly coated with the activating agent. In addition, since the spray gun 41 radially spays the activating agent for a predetermined range, the traversing orbit in which the spray gun 41 reciprocates corresponds to almost the center of the activation area Z2 (see FIG. 5(*b*)).

In addition, the spray gun 41 reciprocates with a stroke larger than the dimension of the width of the transfer film F and is configured to spray the activating agent over the dimension of the width of the transfer film F. The reason for this is that the transfer film F is uniformly elongated and extended such that a portion for which the activating agent is not sprayed is not present in the transfer film F. Accordingly, on the outer side of the transfer film F, a redundant or unnecessary activating agent (an activating agent that is not used for the original purpose of activating the ink of the transfer film F) is necessarily sprayed (floats) on the surface of the transfer liquid.

Thus, according to this technique, the front and rear sides and both side portions of the spray gun (exhaust nozzle) 41 reciprocating are covered with a hood 42, and particularly, a redundant/unnecessary activating agent is prevented from being sprayed to the outside of the activation area Z2, whereby the operation environment is not degraded. Since the hood 42 is disposed with a clearance from the transfer film F disposed on the liquid surface more or less, it is preferable that the activating agent does not leak from the clearance as possibly as can. In addition, a redundant/unnecessary activating agent component disposed on the surface of the liquid drains (is collected) by an elongation and extension reduction prevention mechanism 8 (a catch basin 82 to be described later, a small submersible pump or the like) together with the transfer liquid L, and a redundant/unnecessary activating agent that floats and is scattering inside the hood 42 is simultaneously sucked in accordance with an air flow generated inside the hood 42 by the drain and is mixed with the transfer liquid L to be discharged. In addition, the collected transfer liquid L is processed to be mixed with air containing the unnecessary activating agent component and then is wasted.

In addition, the activation area Z2, usually, is set to a position located farther than the liquid contact point Z1 at which the transfer film F is supplied to the transfer tank 2 more or less. The reason for this is for softening the water-soluble film of the lower side of the film by containing water therein between them (between the liquid contact and the activation), so that the whole film can be uniformly elongated and extended without any distortion at the time of activation performed thereafter (this may be referred to as a stage for preparing elongation and extension). In other words, ink, which is in a dried state, disposed on the upper side of the film has the elongation and extension suppression state being cancelled at once in accordance with the application of the activating agent and is elongated and extended uniformly to the left and right sides without any distortion in the widthwise direction that is secured as an escape route of stress, and the interval from the liquid contact to the activation may be regarded as a swelling interval (softening interval) for causing the water-soluble film on the lower side of the film to follow the elongation and extension.

As the activating agent, any may be used which can return the dried state of ink on the transfer film F (transfer pattern) to a wet state that is equal to the state right after printing so as to form a transferable state, for example, a material composed by mixing a pigment, a solvent, a plasticizer, or the like into a pitch at an appropriate ratio may be applied, and only a solvent such as a thinner that can give plasticity to the ink may be used.

Next, the transfer tank 2 will be described. The transfer tank 2 supports the transfer film F to float at the time of performing the liquid pressure transfer and has a processing tank 21 that can store the transfer liquid L at an almost constant liquid level (water level) as its main constituent member. Accordingly, the processing tank 21 has an open top face and forms a bottomed shape of which the front, rear, left, and right sides are surrounded by the wall faces. Particularly, reference numeral 22 is attached to both side walls configuring the both right and left sides of the processing tank 21. In addition, in performing the liquid pressure transfer, the transfer tank (processing tank 21) is formed such that the direction from immersion to liquid leaving in which the object W is moved is the longitudinal direction thereof, in other words, the longitudinal direction is formed from the transfer area Z3 toward the liquid-leaving area Z4.

When a liquid pressure transfer is continuously performed (so-called continuous processing), generally, a liquid flow for sending the transfer liquid L from the liquid contact point Z1 (upstream side) to the transfer area Z3 (downstream side) is formed in a liquid surface portion of the processing tank 21. More specifically, for example, as illustrated in FIG. 2, an overflow unit 23 is formed in a downstream end portion of the transfer tank 2, and, by mainly supplying the transfer liquid L collected therein from the upstream portion of the transfer tank 2 through a circulating pipe path 24 in a cyclic manner, the above-described liquid flow is formed near the liquid surface of the transfer liquid L. It is to be understood that cleaning facilities such as a sedimentation tank, filtering, and the like are disposed in the overflow unit 23 or the circulating pipe path 24, and foreign substances such as redundant films and film residuals dispersing and staying in the transfer liquid L can be removed from the collected liquid (suspension), and the collected liquid can be reused. In addition, in the reuse, as illustrated together in FIG. 2 described above, it is preferable that, after a solid content such as ink is precipitated from the suspension collected by the overflow unit 23, the water temperature thereof is adjusted by temperature adjustment devices such as a temperature sensor and a heater, and then, a resultant liquid is provided for the reuse (sent to the upstream side of the transfer tank 2). Here, reference numeral "23A" in the figure represents an overflow tank that is a main member of the overflow unit 23, and the overflow tank contributes to the maintaining of the liquid surface level of the transfer tank 2 to be approximately constant and the cyclic use of the transfer liquid L by collecting the transfer liquid L containing film scraps and the like and is frequently disposed in a conventional transfer tank.

In addition, the transfer tank 2 is formed such that, after the activation area Z2, particularly, the transfer area Z3 is deepened.

In the transfer tank 2, as described above, the pre-activation guide mechanism 6 guiding the transfer film F supplied to the transfer tank 2 up to the activation area Z2, the post-activation guide mechanism 7 guiding the transfer film F after the application of the activating agent up to the transfer area Z3, and the elongation and extension reduction prevention mechanism 8 for promoting of elongation and extension of the transfer film F by removing an activating agent component disposed on the surface of the transfer liquid are disposed, and hereinafter, these will be described.

First, the pre-activation guide mechanism 6 will be described. The pre-activation guide mechanism 6 is disposed on the inner side of the both side walls 22 of the transfer tank 2 in the previous stage of the activation area Z2 and guides a transfer film F up to the activation area Z2 while holding both sides of the film at horizontally equivalent positions from the transfer film F supplied to the liquid surface disposed at the center of the transfer tank 2.

The pre-activation guide mechanism 6, as illustrated in FIG. 1 as an example, is configured by a conveyer 61 formed by winding an endless belt 63 around pulleys 62. Here, as the pulleys 62, there are pulleys that are directly driven by a motor or the like and pulleys to which rotation is delivered through the belt 63. When these are desired to be discriminated from each other, the former is referred to as a driving pulley 62A, and the latter is referred to as a driven pulley 62B. In the embodiment illustrated in FIG. 1, the rotation shaft 64 of the pulley 62 is set to an almost vertical direction, and the widthwise direction of the belt 63 is formed to be the depth (height) direction of the surface of the transfer liquid. The reason for this is that, even when the level of the liquid inside the transfer tank 2 changes, it can be responded by the dimension of the width of the belt 63, and accordingly, the height of the whole conveyer 61 does not need to be changed.

By the pre-activation guide mechanism 6 (conveyer 61), the transfer film F supplied to liquid surface at the center of transfer tank 2 is conveyed to the activation area Z2 in the state in which both sides disposed at the horizontally equivalent positions are regulated, and accordingly, a deviation, position mismatch, meandering, or the like does not occur in the transfer film F that is in the process of conveyance. In other words, the pre-activation guide mechanism 6 may be regarded as prevention of positional mismatch of the transfer film F before activation in the width direction or center alignment.

In addition, the holding of both sides of the transfer film F using the pre-activation guide mechanism 6 may be regarded also as the regulation of the widthwise direction, and in such a case, it may be considered that the pre-activation guide mechanism 6 promotes swelling and enlargement of the water-soluble film of the lower side of the film in the thickness direction and, as a result, limits (regulates) the swelling and enlargement in the widthwise direction of the film. Even when the transfer film F comes in contact with the liquid, ink disposed on the upper side of the film is maintained to be hard, and accordingly, the widthwise swelling is regulated using the ink. However, the pre-activation guide mechanism 6 is also responsible for the action of regulating widthwise swelling or is considered to strengthen such an action. In addition, the swelling (promoting) of the transfer film F before activation in the thickness direction is, as described above, for elongating and extending the transfer film F in the widthwise direction to be horizontally equivalent without any distortion in the activation stage. As above, although the pre-activation guide mechanism 6, originally, is responsible for the action of position matching, it may be regarded to supply the transfer film F to the activation area Z2 while promoting swelling in the thickness direction and suppressing elongation and extension in the widthwise direction for the transfer film F until a time point right before activation.

The holding of both sides of the transfer film F using the pre-activation guide mechanism 6 is cancelled (released) right before the activation area Z2. In other words, both sides of the film coated with the activating agent are in a free state, and the reason for this is that the elongation and extension according to the application of the activating agent is not inhibited by the pre-activation guide mechanism 6. The transfer film F is sent from the liquid contact point Z1 to the activation area Z2 (and further up to the transfer area Z3) in a connected state, and, even when the holding of both sides is cancelled from right before the activation area Z2, the guide action according to the pre-activation guide mechanism 6 is applied to a portion disposed on the upstream side, and, in the film as a whole, a position matching function acts also in the activation area Z2.

In addition, since the transfer film F arrives at the activation area Z2 right after being released from the pre-activation guide mechanism 6, the transfer film is released from the pre-activation guide mechanism 6 even in a state in which the activating agent is not applied and start to elongate and extend more or less (the degree of elongation and extension is lower than that according to the application of the activating agent).

In addition, in order to respond to transfer films F having various mutually-different widths, it is preferable that such a pre-activation guide mechanism 6 (conveyer 61) has a configuration in which a gap between the left and right belts 63 is freely adjustable, and, hereinafter, such an embodiment will be described. As such a configuration (width dimension adjustment function), for example, as illustrated in FIG. 8(*a*), there is a technique in which an arm bar 65 supporting the pulley 62 (driven pulley 62B) to be rotatable in the leading end portion is arranged to be freely stretchable (able to protrude) from the side wall 22 of the transfer tank 2 (so-called stretchable type). In addition, the arm bar 65 may be fixed to an arbitrary position (with protrusion dimension) by using a clamp 66 or the like.

In addition, as illustrated in FIG. 8(*b*), a technique may be considered in which the arm bar 65 supporting the pulley 62 is arranged to be freely rotatable with respect to the side wall 22 of the transfer tank 2, and this arm bar 65 is fixed to an arbitrary rotation position by using a clamp 66 or the like (so-called swing type). It is to be understood that the stretchable type and the swing type may be used in a combinational manner in places without any problem.

Furthermore, while the pre-activation guide mechanism 6 is configured by the belt 63 in the present example, a chain, a relatively thick rope, wire, or the like may be used.

Figure 7:
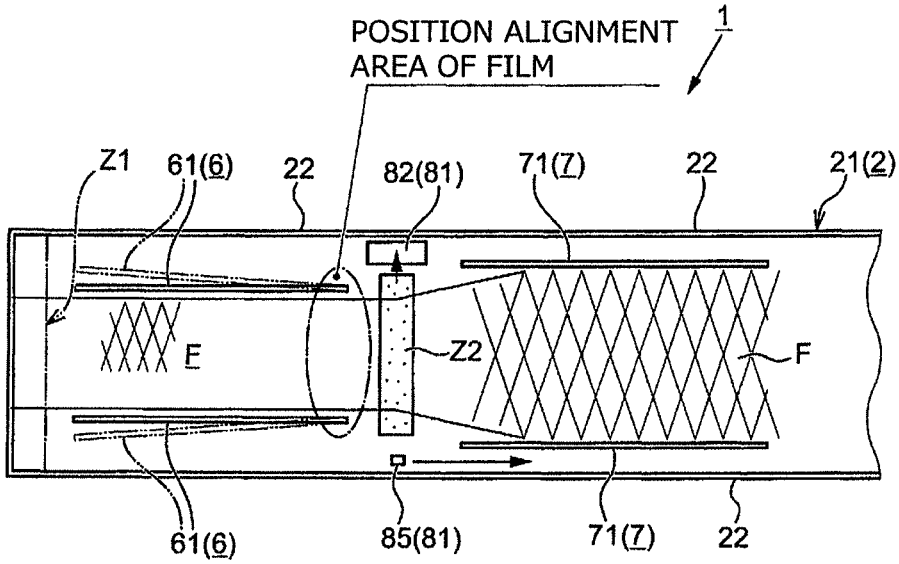
FIG. 7 is a plan view that illustrates a pre-activation guide mechanism, an elongation and expansion reduction prevention mechanism, and the like according to another embodiment.

In addition, in the present example, while the pre-activation guide mechanism 6 is arranged such that the left and right belts 63 are almost parallel to each other, the position matching of the transfer film F according to the pre-activation guide mechanism 6 may be performed until the transfer film F is sent to the activation area Z2. Thus, for example, as illustrated in FIG. 7, the pre-activation guide mechanism 6 (conveyer 61) may be arranged such that the gap between the left and right belts gradually decreases from the liquid contact point Z1 to the activation area Z2, in other words, in the shape of "A" in the plan view.

Next, the post-activation guide mechanism 7 will be described. The post-activation guide mechanism 7 is provided on the inner side of both side walls 22 of the transfer tank 2 in the rear stage of the activation area Z2 and guides the transfer film F up to the transfer area Z3 while holding both sides of the transfer film F after activation. The transfer film F coated with the activating agent extends (spreads) in the widthwise direction only for which there is no restriction in a horizontally equivalent manner without any distortion, and the extension ends when the transfer film arrives at the post-activation guide mechanism 7 (chain conveyer 71), whereby this mechanism is also responsible for the action of regulating the extension of the film from both sides. In other words, the post-activation guide mechanism 7 (chain conveyer 71) conveys the transfer film F up to the transfer area Z3 in the state in which the extension of the transfer film F is maintained to be almost constant, and, from this, the extension of the transfer film F is maintained to the same level in the transfer area Z3, whereby a continuous accurate transfer can be performed.

As the post-activation guide mechanism 7, as illustrated in FIG. 1 as an example, a chain conveyer 71 is applied, this is formed by winding a chain 73 around a sprocket 72, and the rotation shaft 74 of the sprocket 72 is set to be horizontal. In other words, the chain 73 is vertically arranged so as to travel on the liquid surface and the middle of the liquid in a cyclic manner and is set such that the center of the chain 73 matches the level of the liquid surface near the liquid surface. Accordingly, the uppermost face of the chain 73 appears (protrudes) on the upper side of the level of the liquid surface more or less, and, from this, the chain 73 is configured to be in contact with both sides of the transfer film F on the liquid surface and be relatively firmly maintained.

Here, since the post-activation guide mechanism 7 is disposed at the rear stage of the activation area Z2, the width dimension (the gap between the chain conveyers 71) that holds and regulates both sides of the transfer film F according to this mechanism is naturally set to be larger than the width dimension (the gap between the conveyers 61) holding both sides of the transfer film F according to the pre-activation guide mechanism 6. Here, the post-activation guide mechanism 7 does not necessarily need to be configured by the chain conveyer 71 but may be configured by a belt, a relatively thick rope, wire, or the like.

Also in the post-activation guide mechanism 7 (chain conveyer 71), the width dimension does not necessarily need to be maintained as being constant, the chain conveyer 71 may be arranged such that the horizontal width dimension gradually decreases from the activation area Z2 toward the transfer area Z3 (in other words, toward the downstream). From this, by tightening the transfer pattern of the transfer film F after activation (suppressing the extension of the pattern), the transfer pattern (pattern) can be transferred more sharply.

Figure 4:
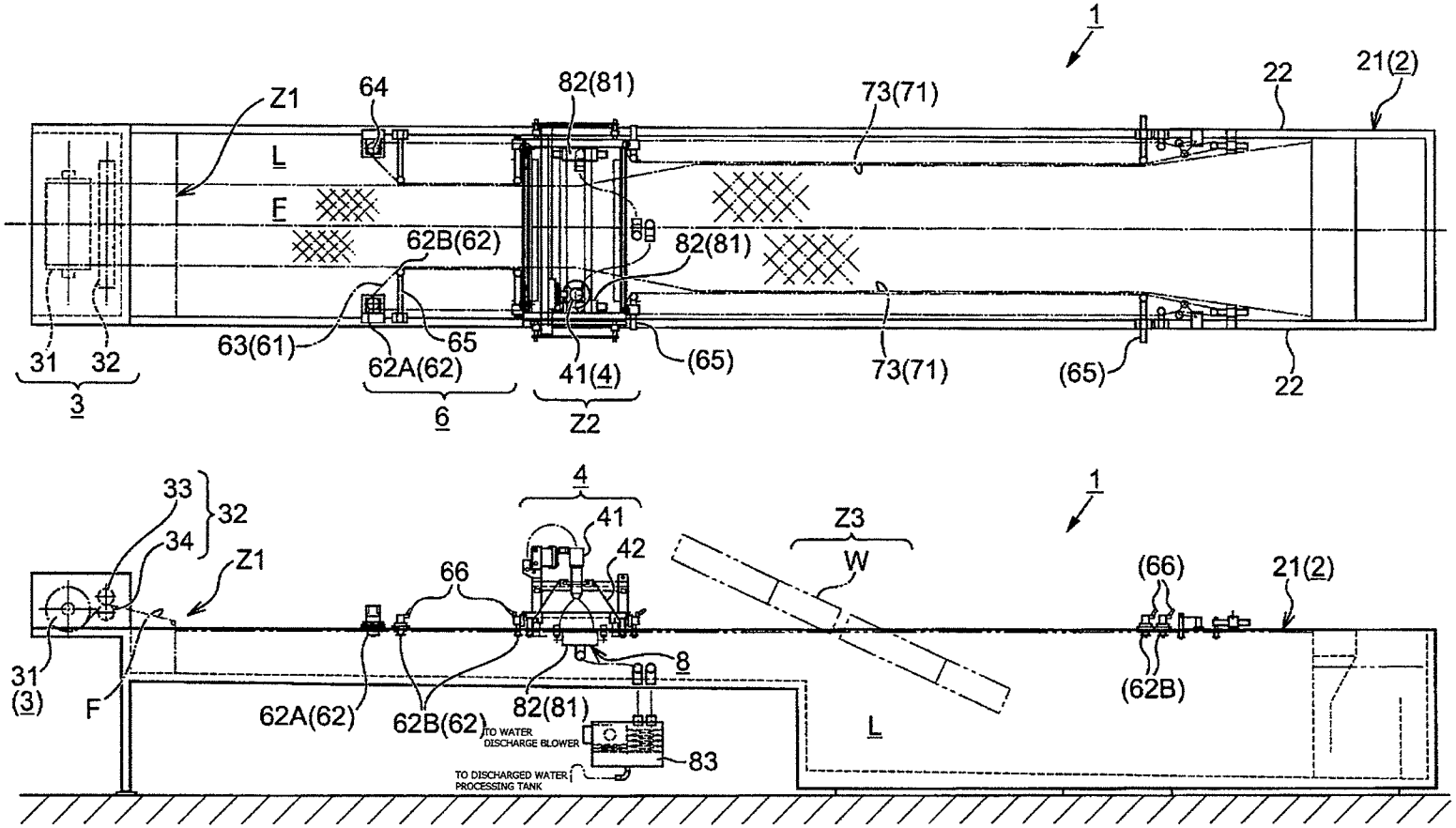
FIG. 4 represents a plan view and a side view that illustrate a post-activation guide mechanism (and a pre-activation guide mechanism), in which some aspects are changed, of the above-described liquid pressure transfer device.

In the example illustrated in FIG. 1, although the pre-activation guide mechanism 6 and the post-activation guide mechanism 7 are configured to be completely independent from each other (for example, separate configurations of the conveyer 61 using the belt 63 and the chain conveyer 71), for example, as illustrated in FIG. 4, the guide member (here, the belt 63) holding both sides of the film using the pre-activation guide mechanism 6 may be handled (applied also as the post-activation guide mechanism 7) even after that activation area Z2, and the transfer film F extending in accordance with activation may be held by the same guide member. In such a case, in the activation area Z2, an arrangement is employed in which the guide member (belt 63) avoids the activation area Z2, for example, the guide member retreats near the side wall 22 (see FIG. 5(*a*)) or enters deeply in the liquid. In such a form (a form in which the guide member holding both sides of the film is shared by the pre-activation guide mechanism 6 and the post-activation guide mechanism 7), the transfer film F can be conveyed at the same speed before and after the activation, and, in a case where a transfer is desired to be performed with the speed of the film are the same in the activation area Z2 and the transfer area Z3, the transfer can be efficiently performed.

In contrast to this, as illustrated in FIG. 1, in a case where the pre-activation guide mechanism 6 and the post-activation guide mechanism 7 are formed to be completely independent from each other, the conveying speed of the transfer film F before and after activation can be changed, and accordingly, in a case where the speed of the film is desired to be different in the activation area Z2 and the transfer area Z3, the transfer can be efficiently performed.

In addition, the pre-activation guide mechanism 6 and the post-activation guide mechanism 7 are preferably disposed to be freely movable to the front and rear sides (the upstream side is set as the front side) with respect to the transfer tank 2, so that the activation timing and the transfer timing, including the activating agent applying device 4, can be appropriately set.

Next, the elongation and extension reduction prevention mechanism 8 will be described.

In the present invention, since the activating agent is applied (sprayed) to the film on the liquid surface, the activating agent is applied to an outer portion exceeding both sides of the transfer film F so as to uniformly extend the transfer film F, and the like, a situation is formed on the surface of the transfer liquid in which a redundant/unnecessary activating agent may easily float and stay on the liquid surface. In this embodiment, such an activating agent component, for acting to inhibit the extension of the transfer film F, is collected and removed by a removing means 81 in the activation area Z2 or at a position (hereinafter, simply referred to as a "prior-contact point") right before the transfer film F extending in accordance with activation comes into contact with the post-activation guide mechanism 7, and this is the elongation and extension reduction prevention mechanism 8.

Accordingly, the elongation and extension reduction prevention mechanism 8 (removing means 81) may be regarded as a mechanism that is used for causing the transfer film F to come in contact with the guide mechanism, particularly, the post-activation guide mechanism 7 reliably and stably by collecting and removing an activating agent component floating on the liquid surface and promoting the extension of the transfer film F to be enlarged by the activation. Accordingly, even when a transfer is repeatedly performed, the transfer film F that is horizontally extended uniformly without any distortion in accordance with activation continuously comes into contact with the guide mechanism (post-activation guide mechanism 7) in a stable manner (the promotion of extension is continued), and an accurate transfer can be continuously performed.

Here, details why the activating agent component floating and staying on the surface of the transfer liquid inhibits the extension of the transfer film F will be described.

Since the holding (regulating) of both sides of the film using the pre-activation guide mechanism 6 is cancelled in the activation area Z2, between the activation area Z2 and the post-activation guide mechanism 7, the flow on the liquid surface tends to be weakened, and particularly, an activating agent applied to run off the film in the activation area Z2 may easily stay therein. Accordingly, when the liquid pressure transfer is repeatedly performed in the state, the activating agent component gradually increases on the surface of the transfer liquid in the activation area Z2, and enters between the transfer film F and the guide mechanism (post-activation guide mechanism 7) and acts so as to prevent the extension (enlargement) of the transfer film F. When such a situation is formed, the transfer film F does not arrive at the guide mechanism, and horizontally uniform extension cannot be acquired, and the conveyance of the film is non-uniform, whereby various defects such as pattern bending and pattern distortion may occur.

In the present example, as described above, the elongation and extension reduction prevention mechanisms 8 (removing means 81) are arranged in both the activation area Z2 and the prior-contact point. Out of these, the removing means 81 arranged in the activation area Z2 mainly removes and collects an activating agent (activating agent component) which is sprayed on the liquid surface to run off to the outside of the transfer film F, and, as this, the catch basin 82 is applied.

Figure 5:
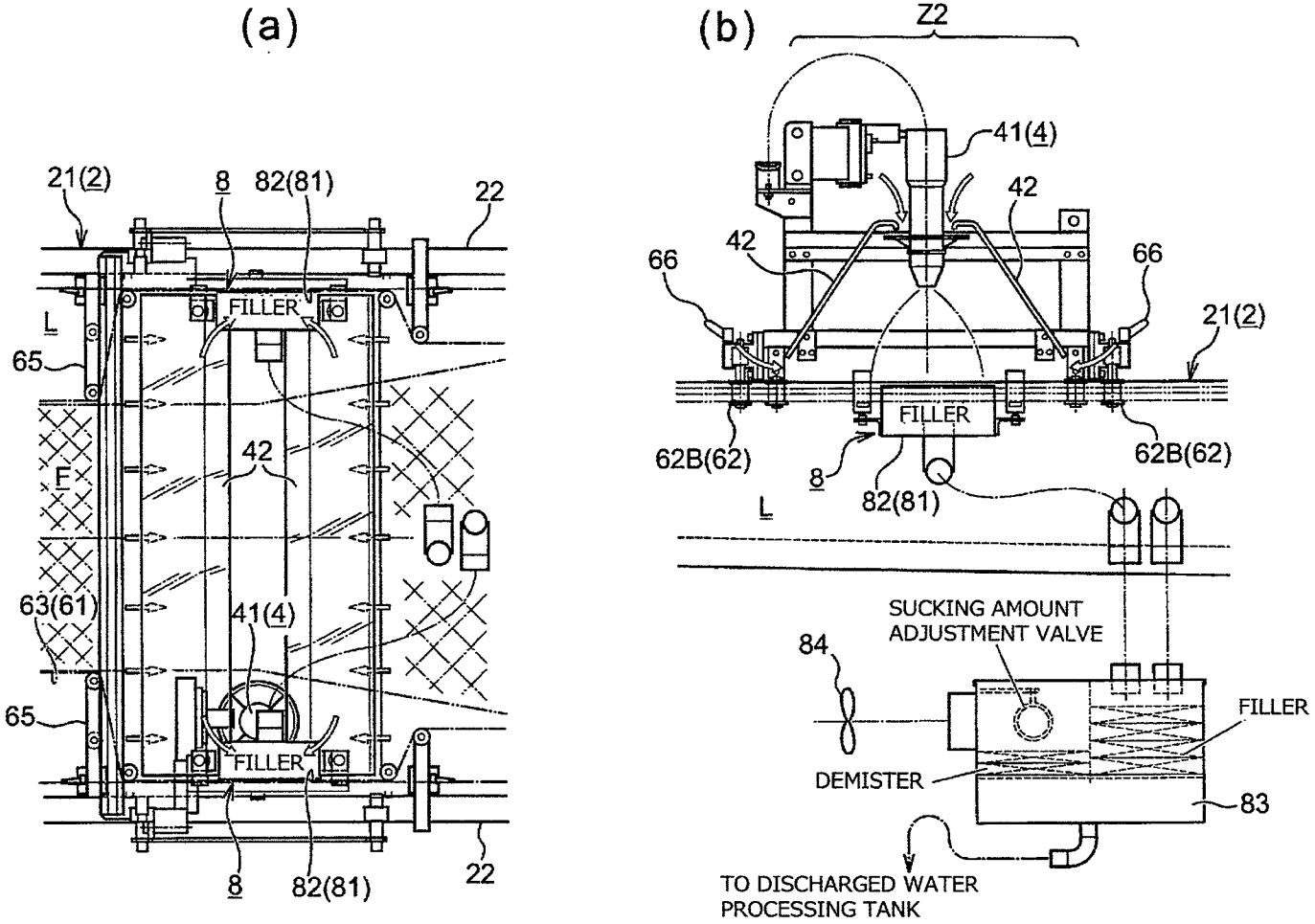
FIG. 5 represents a plan view (a) and a side view (b) that illustrate the appearance of an air stream generated inside a hood disposed in an activation area in accordance with a catch basin and the appearance of cleaning air containing an unnecessary activating agent component collected in accordance with the air stream by causing it to be penetrated into a transfer liquid (collected liquid).

In the catch basin 82, for example, a sucking port (collecting port) is disposed upward under the water surface (for example, a position immersed by about 4 mm from the liquid surface). Here, in the collection using the catch basin 82, although a vacuum technique in which the activating agent component disposed on the liquid surface is aggressively sucked in together with the transfer liquid L is preferable, a collection form (so-called overflow) may be employed in which the activating agent component disposed on the liquid surface is caused to naturally fall overhead together with the transfer liquid L. In the case of the vacuum technique for aggressively sucking the activating agent component disposed on the liquid surface together with the transfer liquid L, for example, as illustrated in FIG. 5, air inside the hood 42 can be sucked and discharged together, and, from this, the flow of air flowing from a clearance between the hood 42 and the transfer film F or an opening portion formed in the upper portion of the hood 42 so as to reciprocate the spray gun 41 toward the catch basin 82 is generated inside the hood 42, and this air flow contributes also to the discharge of the activating agent (a redundant/unnecessary activating agent floating inside the hood 42), whereby there is an advantage of reducing the smell of the solvent on the periphery of the spray activation device (activating agent applying device 4). In addition, it is preferable to arrange one pair of the catch basins 82 on both outer sides (both side portions) of the film in which the spray gun 41 reciprocates.

In addition, as illustrated in FIG. 5 (particularly, in FIG. 5(*b*)), it is preferable to arrange fillers promoting an air-liquid contact on the inner side of the catch basin 82 (suction port), and it is more preferable to arrange a mist separator 83 in which fillers and a demister are built at the water-discharging side rear stage of the catch basin 82, and accordingly, the air containing an unnecessary activating agent component and the transfer liquid (collection liquid) can be mixed and discharged more efficiently. From this, in the present example, the air containing the unnecessary activating agent component can be completely melted into the transfer liquid (collection liquid), and the melted collection liquid is circulated by a submersible pump so as to be reused or discharged (exhausted). Furthermore, from this, an activating agent and the smell of the solvent are completely removed from the exhausted air (air) discharged from an exhaust fan 84, and accordingly, a high-priced solvent collection device does not need to be disposed, and the process of exhausting and water-discharging the activating agent and the solvent component can be efficiently performed.

As above, in this embodiment, since the activating agent component to stay on both sides of the activation area Z2 is effectively collected by the catch basin 82, the transfer film F after activation can be easily extended to be horizontally uniform. In addition, in accordance with the liquid flow flowing toward the catch basin 82, an advantage of extending the transfer film F after activation to be horizontally uniform can be expected.

In addition, as the removing means 81 provided in the activation area Z2, not only the catch basin 82 (including a technique of the overflow of naturally falling water) but also a small submersible pump (vacuum pump) or the like can be applied.

Meanwhile, the removing means 81 that is disposed at the prior-contact point removes the activating agent component to be a liquid film and spread on the surface of the transfer liquid between the post-activation guide mechanism 7 (chain conveyer 71) and the transfer film F, and here, a blow technique is employed. In other words, in the activation area Z2, as described above, the activating agent component is considered to easily stay, and accordingly, the air used for removing the activating agent component, as illustrated in FIG. 1 as an example, the activating agent component that may easily stay at the prior-contact point from the activation area Z2 is blown by the air so as to be pushed out (sent) to the rear side of the guide, in other words, a position between the post-activation guide mechanism 7 and the side wall 22. In addition, the rear side of the guide is a portion that does not have substantial influence on the transfer or have a little influence on the transfer by setting the upper face of the post-activation guide mechanism 7 to a position higher than the surface of the transfer liquid and the like.

In addition, a portion that pushes the activating agent component that may easily stay at the prior-contact point from the activation area Z2 is not limited to the rear side of the guide, and the activating agent component may be sent to the catch basins 82 (or the submersible pumps) disposed on both sides of the activation area Z2 and be collected therefrom.

A specific configuration of the removing means 81 removing the activating agent component located at the prior-contact position will be further described. As an example, as illustrated in FIG. 1, two compressed air blow nozzles 85 are used. This compressed air extraction nozzle 85, as illustrated in the figure, preferably includes a multi-joint type flexible hose, and which enables fine adjustment of the position of the nozzle, the air blowing direction, and the like to be performed in an easy manner.

In addition, in the air blowing for removing the activating agent component, it is preferable that the blowing is applied to the surface of the transfer liquid on which the film is not present without directly applying (putting) the blowing to the transfer film F, and, in such a case, the surface of the transfer liquid is stably maintained, and the transfer film F is conveyed to the transfer area Z3 in a state in which there is no ripple as possible as can. In addition, in that point, as the compressed air extraction nozzle 85, it is preferable that air is applied to a target liquid surface in a pin-point manner by using a nozzle formed in a tapered shape toward the discharge port.

In the example illustrated in FIG. 1, while the air blows applied from two compressed air extraction nozzles 85 are in the blowing form reversing the flow of the transfer liquid, the two compressed air extraction nozzles 85 may have a small capacity (air blowing power) to a degree for sending the activating agent component (liquid film) disposed on the liquid surface to the catch basin 82, the small submersible pump, or the rear side of the guide, and there is no concern that the air blows according to the compressed air extraction nozzle 85 block the flow of the transfer liquid L. It is apparent that the air blows according to the compressed air extraction nozzles 85, for example, as illustrated in FIG. 7, may be performed almost along the flow of the transfer liquid L (toward the downstream side).

In the example illustrated in FIG. 1, as described above, while a form in which the elongation and extension reduction prevention mechanisms 8 (removing means 81) are arranged both in the activation area Z2 and at the prior-contact point is basically employed, and both the catch basin 82 and the compressed air extraction nozzle 85 are arranged, but any one thereof may be arranged as long as the activating agent component can be removed to a degree for which the extension of the transfer film F can be continuously performed by any one of the removing means 81. Accordingly, for example, the catch basin 82 operated in the activation area Z2 located on the upstream side is considered as a main removing means 81, and a form may be acquired in which the compressed air extraction nozzle 85 is operated (or arranged) in a case where the removal capacity of the catch basin 82 is insufficient, and the activating agent component is prevented from entering between the transfer film F and the post-activation guide mechanism 7 (chain conveyer 71). In addition, mutually-different removing means 81 may be horizontally arranged, and, for example, in FIG. 7, the catch basin 82 is arranged near the left side wall 22 of the liquid flow when seen in the plan view, and the compressed air extraction nozzle 85 is arranged near the side wall 22 located on the opposite side.

Next, the object conveying device 5 will be described. The object conveying device 5 immerses the object W into the transfer liquid L with an appropriate posture and pulls up the object W from the transfer liquid L and, generally, achieves the attachment of the object W through a transfer jig 52 (hereinafter, simply referred to as a jig 52). In other words, when the liquid pressure transfer is performed, the object W is attached to the jig 52 in advance, and this jig 52 is attached/detached to/from a jig holder so as to be set to the conveyer 51. Hereinafter, the conveyer 51 will be described further.

For example, as shown in FIG. 3, the conveyer 51 is formed by horizontally extending link bars to one pair of link chains 53 arranged to be parallel to each other and arranging jig holders in the link bar at a predetermined interval and causes the object W to be continuously immersed into the transfer liquid L or leave the transfer liquid L together with the jig 52. Here, the mounting of the object W (jig 52) to the conveyer 51 on the immersion side or the detachment of the object W (jig 52) from the conveyer 51 on the liquid leaving side after the transfer may be performed automatically by a robot or performed manually by an operator. In addition, generally, the conveyance speed (particularly, the speed in the immersion area) of the object W according to the conveyer 51 is set so as to be approximately tuned to the movement speed of the transfer film F on the liquid surface.

In addition, the conveyer 51, as illustrated in FIG. 3 as an example, is a common triangular conveyer drawing a conveying orbit having an inverted triangle when seen from the side face, and the immersion of the object W, in other words, the transfer is performed in an apex portion disposed on the lower side, and so-called a short-time or instant immersion transfer is performed. In addition, the entire triangular conveyer (conveyer 51) is configured to be freely bent, and it is preferable that the immersion angle of the object W is configured to be appropriately changeable according thereto.

Furthermore, the object conveying device 5 is not necessarily limited to the above-described conveyer 51, but, for example, a robot may be used (a multi-joint robot and so-called a manipulator).

Next, the film detaching and cleaning device 9 will be described. The film detaching and cleaning device 9 washes away a half-dissolved water-soluble film that adheres to and remains on the film from the surface of the object W pulled up from the transfer liquid L (only a transfer pattern transferred to the surface of the object W is caused to remain) and, as illustrated in FIG. 2 as an example, is formed by a conveyer 91 that places and conveys an object W taken out from the transfer tank 2 (transfer area Z3), a warm water shower 92 that sprays water (warm water) to the object W conveyed on the conveyer 91, a rinse water shower 93 that sprays rinse water to the object W after water cleaning, and a storage tank 94 that stores the warm water and the rinse water (discharged cleaning water containing dissolved water-soluble film) after film detaching and cleaning. In addition, in the storage tank 94, an overflow unit 23 is formed and is connected to the transfer tank 2 through a circulating water discharge pipe path 95, and discharged cleaning water (discharged film detaching and cleaning water containing a water-soluble film) overflown by the storage tank 94 is drawn right before the overflow unit 23 of the transfer tank 2, and the water-soluble film washed off in the film detaching and cleaning process is also deposited and collected therein.

In the middle of the circulating water discharge pipe path 95, a filter is preferably arranged, and it is preferable to remove foreign substances such as water-soluble films and the like generated in the film detaching and cleaning process also therein. In addition, in a case where water is desired to be circulated and used as much as possible as above, water for the warm water shower 92 and water for the rinse water shower 93 may be also reused from the storage tank 94. In such a case, it is preferable to arrange filters removing foreign substances in supply pipe paths 92*a* and 93*a* for the warm water shower 92 and the rinse water shower 93.

Here, advantages of a case where water is circulated and used as much as possible (a case where discharged water after film detaching and cleaning is resupplied to the transfer tank 2) will be described.

COMPARATIVE EXAMPLE

First, according to a conventional liquid pressure transferring technique, in other words, in a system in which discharged water after film detaching and cleaning is not resupplied to the transfer tank 2, a weekly amount of the transfer, the amount of replaced transfer water, and a change in the PVA density are as represented in a table and a graph illustrated in FIG. 9. When the PVA density was 500 ppm or less, the transfer film F was hard and the attachment and circulating property was inferior, thereafter, a good film state was continued, and, when the PVA density rose to 3000 ppm, the transfer film F excessively softened, and the occurrence of a transfer defect tended to increase. The amount of water of the transfer tank replaced and supplemented for one week was 23 tons.

EXAMPLE

On the other hand, in the present system in which discharged water after film detaching and cleaning is resupplied to the transfer tank 2, the film detaching and cleaning device 9 performed the warm water shower 92 and the rinse water shower 93 of 20 L/min using two storage tanks 94 and a circulation pump, and film detachment water of 15 L/min was introduced from the terminal end middle layer portion of the storage tank 94 to the transfer tank 2 (see FIG. 2). The PVA density of the film detachment water was 600 ppm after 3 hours and 1200 ppm after 8 hours.

The initial PVA density of the transfer tank 2 was adjusted to 500 ppm, and transfer processing was continued while the above-described film detachment water was introduced. As a result, the PVA density of the transfer water was 1350 ppm after 8 hours, 1700 ppm after 16 hours, 2000 ppm after 80 hours, and 2040 ppm after 160 hours, the characteristics of the transfer film were stabilized, and there was no defect due to the transfer film F.

As water of the transfer tank discharged therebetween, bottom water containing ink residuals collected at the bottom of the sedimentation tank was about 200 L once per two days and was about 600 L for a week. The number of processes of the operation of replacing the water of the transfer tank for two weeks decreased, the amount of replaced water decreased by 45 tons, and accordingly, not only a decrease in the transfer defect but also an advantage that is particularly useful in an area in which water resources are valuable was acquired.

The liquid pressure transfer device 1 is configured as above, and hereinafter, while the operation form (liquid pressure transfer method) of the liquid pressure transfer device 1 is described, a method of activating the transfer film will be described together.

(1) Before Activation: Supply of Transfer Film (Before Floating on Liquid Surface)

In performing a liquid pressure transfer, first, a transfer film F is supplied to the transfer tank 2 storing the transfer liquid L. Here, as described above, since activation is performed on the liquid surface, the transfer film F is supplied to the transfer tank 2 without being activated. At that time, the transfer film F is supplied to the transfer tank 2 while passing through the projection and depression molding roller 32, and, from this, the transfer film F is continuously sent to the surface of the transfer liquid in a state in which curl-prevention projections and depressions R are formed on both side portions.

(2) Before Activation: Prevention of Curl

The transfer film F supplied to the surface of the transfer liquid is formed such that the curl-prevention projections and depressions R formed on both sides have sufficient resilience (strength) against bending in the widthwise direction, and the like, whereby the curl phenomenon is prevented. Accordingly, the transfer film F supplied to the surface of the transfer liquid does not have the occurrence of a curl in which both sides are oppositely separated away from the liquid surface and reliably comes into contact with the pre-activation guide mechanism 6 (the belt 63 of the conveyer 61), whereby both sides are accurately held. In addition, from this, the transfer film F is conveyed to the activation area Z2 without being deviated to one side wall 22 and causing any position mismatching and meandering. Furthermore, the effective use width of the film can be broadened, and the elongation and extension rate in the widthwise direction is suppressed, whereby the feeling of pattern extension can be relieved, and a high-precision transfer design can be represented. In addition, in order to form the curl-prevention projections and depressions R, not only the projection and depression molding roller 32 but also a laser marker 37 may be applied. In such a case, curl-prevention projections and depressions R that are finer than those of the projection and depression molding roller 32 can be formed.

(3) Before Activation: Status of Transfer Film while being Held by Pre-Activation Guide In the transfer film F having both sides held by being brought into contact with the pre-activation guide mechanism 6, the position in the widthwise direction of the film is regulated in accordance with the holding, swelling and expansion in the thickness direction are promoted. In other words, the transfer film F after a contact with the liquid, particularly, the water-soluble film of the lower side of the film is swollen and expanded in the thickness direction until reach of the activation area Z2, and, as a result, a state is formed in which swelling and expanding in the widthwise direction are regulated. In addition, the reason for causing the transfer film F (water-soluble film) before activation is swollen in the thickness direction is for elongating and extending the transfer film F in the widthwise direction to be horizontally uniform without any distortion in the activation stage performed thereafter.

(4) Activation: Cancellation of Guide Action According to Pre-Activation Guide Mechanism Thereafter, although the activating agent is applied when the transfer film F arrives at the activation area Z2, first, a guide action (holding action) according to the pre-activation guide mechanism 6 is cancelled right before the arrival. In other words, the transfer film F is coated with the activating agent in a free state in which both side portions are not held and regulated in the activation area Z2. Since the transfer film F is sent from the liquid contact point Z1 up to the activation area Z2 (furthermore, up to the transfer area Z3) in a continuous state, even when the holding of both sides is cancelled in the activation area Z2, a guide action according to the pre-activation guide mechanism 6 is applied to a portion disposed on the upstream side, and, as a whole of the film, the position mismatching prevention function is applied also in the activation area Z2.

(5) Activation: Elongation and Extension of Transfer Film in Widthwise Direction As above, the transfer film F is coated with the activating agent in the state in which the holding and regulating of both sides of the film are cancelled in the activation area Z2, and accordingly, the transfer film F is horizontally-uniformly elongated and extended in the widthwise direction without any distortion. Such elongation and extension are caused by not only the action of the activating agent but also the swelling and expanding of the water-soluble film of the lower side of the film in the thickness direction to a degree for following the elongation and extension according to the activation until reach of the activation area Z2 (in advance). In other words, the transfer film F extends in the widthwise direction only for which no regulation is present in accordance with the application of the activating agent such that the thickness dimension that has been swollen and expanded decreases.

(6) Activation: Removal of Activating Agent Component in Activation Area

In addition, in the activation area Z2, the activating agent is applied to run off to the outer side of the side portion of the transfer film F, and accordingly, in the activation area Z2, the activating agent applied to the outside of the film is collected by the removing means (catch basin 82) together with the transfer liquid L. Accordingly, the activating agent component to stay on both sides of the activation area Z2 is collected, and therefore, the transfer film F to be enlarged in accordance with the activation is horizontally-uniformly elongated and extended. In addition, the effect of horizontally-uniformly elongating and extending the transfer film F after the activation can be expected in accordance with the liquid flow flowing toward the catch basin 82.

In addition, in sucking (collecting and discharging) the activating agent component disposed on the liquid surface together with the transfer liquid L using the catch basin 82, as described above, air inside the hood 42 can be sucked and exhausted. Thus, for example, by arranging fillers in the catch basin 82 (sucking port) or passing the collected liquid sucked in from the catch basin 82 through the mist separator 83 in which fillers and a demister are built, a redundant activating agent floating inside the hood 42 is dissolved into the collection liquid (transfer liquid), whereby the smell of the solvent on the periphery of the activating agent applying device 4 can be remarkably reduced.

(7) after Activation: Collection of Activating Agent Component at Prior-Contact Point Although the transfer film F coated with the activating agent component in the activation area Z2 is horizontally-uniformly elongated and extended in the widthwise direction without any distortion and comes into contact with the post-activation guide mechanism 7, for example, in a case or the like in which all the activating agent component may not be collected by the catch basin 82, it is preferable that the activating agent component entering between the post-activation guide mechanism 7 and the transfer film F is sent to the rear side of the catch basin 82 (submersible pump) or the guide by using the compressed air extraction nozzle 85 applied to the prior-contact point. From this, reduction in the elongation and extension of the transfer film F is further prevented, and the transfer film F reliably comes into contact with the post-activation guide mechanism 7 even when the transfer is repeatedly performed.

Thereafter, the transfer film F is conveyed up to the transfer area Z3 while both sides thereof are held and regulated by the post-activation guide mechanism 7. In other words, the transfer film F is conveyed up to the transfer area Z3 in the state in which the position mismatching is prevented or center alignment is performed and in the state of being maintained to a predetermined degree of elongation and extension after activation.

(8) Transfer: Immersion of Object

When the transfer film F that is held and regulated by the post-activation guide mechanism 7 arrives at the transfer area Z3, for example, the objects W held by the object conveying device 5 such as the conveyer 51 are sequentially put into the transfer liquid L at an appropriate posture (with the angle of entering the liquid) and a transfer is performed. This angle of entering the liquid may be appropriately changed in accordance with the shape or the projections and depressions of the object W.

In addition, in a case where the width dimension of the post-activation guide mechanism 7 (chain conveyer 71) gradually decreases from the activation area Z2 toward the transfer area Z3, by tightening the transfer pattern of the transfer film F after activation (suppressing the extension of the pattern), the transfer pattern (pattern) can be transferred more sharply.

(9) after Transfer: Film Detaching and Cleaning Process

After the transfer is completed, the object W getting out of the liquid on the liquid surface is taken away from the object conveying device 5, is loaded on the conveyer 91 of the film detaching and cleaning device 9, and receives the warm water shower 92 and the rinse water shower 93, whereby the water-soluble film disposed on the surface is removed.

In addition, while the discharged film detaching and cleaning water after the film detaching and cleaning process contains foreign substances such as a dissolved water-soluble film, the discharged film detaching and cleaning water is guided right before the overflow unit 23 of the transfer tank 2 by the circulating water discharge pipe path 95, and accordingly such foreign substances are additionally deposited and collected by the overflow unit 23. It is preferable that the foreign substances such as a water-soluble film contained in the discharged film detaching and cleaning water is additionally collected by a filter that is appropriately disposed in the circulating water discharge pipe path 95.

Thereafter, the object W is appropriately dried, top-coated, and the like, thereby becoming a product.

OTHER EMBODIMENT

While the present invention has the embodiment described above as one basic technical concept, the following changes may be further considered.

In other words, in the above-described embodiment, while foreign substances such as film scraps dispersing and staying in the transfer liquid L are collected by using the overflow tank 23A (overflow unit 23) disposed at the terminal end portion of the transfer tank 2, in order to perform the liquid pressure transfer clearer, as illustrated in FIG. 10 as an example, it is preferable to include a design surface cleaning mechanism 10 and to cause the object W to leave the liquid while foreign substances are not allowed to approach the design surface S1 of the object W that is pulled up from the transfer liquid L. As above, the design surface cleaning mechanism 10 is used for cleaning the object W floating in the liquid-leaving area Z4 on the design surface S1 side, and, hereinafter, this design surface cleaning mechanism 10 will be described. First, the design surface S1 will be described.

The design surface S1 is a face of the object W on which the decorative layer is formed and may be regarded as a surface for which a precise transfer is required. The design surface S1 is a surface that faces the transfer film F (transfer pattern) floating on the surface of the transfer liquid at the time of immersion. Particularly, in a case where a transfer pattern also having a surface protection function is formed at the time of performing the liquid pressure transfer, it is preferable that a remaining film, a redundant film, film scraps, bubbles, and the like are not attached to this design surface S1 as possibly as can.

On the other hand, a surface (a surface not requiring a liquid pressure transfer) of the object W on which a decorative layer is not formed is a decoration-unnecessary surface, and film scraps, bubbles, and the like described above may be attached thereto (for example, the transfer pattern going around from the design surface S1 side may be transferred in a distorted state).

Accordingly, in other words, the design surface S1 is a portion that is visually recognized from the outside in a state in which the object W (liquid pressure transfer product) is finally assembled as a finished product through an assembly process or the like, and the decoration-unnecessary surface is a portion that is not visually recognized from the outside in the assembled state and is frequently the rear side of the design surface S1.

Next, bubbles generated in the liquid-leaving area Z4 (the design surface S1 side) will be described. In the liquid-leaving area Z4, the object W (jig 52) is sequentially pulled upward obliquely from the liquid surface, and accordingly, on the upper side of the object W getting out of the liquid, the object W and the jig 52 that has been pulled up to the liquid surface side are located (these will be referred to as the object W and the jig 52 that haven been pulled up antecedently). At that time, for example, the transfer liquid L from the object W and the jig 52 that have been antecedently pulled up may form drops and the drops may fall to the liquid surface of the transfer tank 2. In such a case, for example, there are cases where the fallen drops are splashed on the liquid surface to be bubbles, and the bubble are attached to the design surface S1 of the object W getting out of the liquid. Thereafter, when an ultraviolet ray or the like is emitted to the object W in such a state, due to the stress of the bubbles, the refraction of the ultraviolet ray, and the like, a defect of a pattern distortion in the transfer pattern (decorative layer) or a defect of loss of the pattern occurs in the portion at which the bubbles are attached (so called pinhole). Accordingly, in the embodiment illustrated in FIG. 10, the design surface cleaning mechanism 10 is included for the purposes of the cleaning of the design surface S1 of the object W floating from the transfer liquid L in the liquid-leaving area Z4 (mainly, an action of new water to be described later), the removal of the air bubbles generated on the liquid surface on the design surface S1 side, the exclusion of foreign substances on the surface that are included in the transfer liquid, and the like.

Hereinafter, the design surface cleaning mechanism 10 will be described in detail. The design surface cleaning mechanism 10 forms a liquid flow (a flow toward the downstream) separating away from the design surface S1 of the object W getting out of the liquid, and this will be referred to as a design surface oppositely-separating flow. The purpose thereof is, as described above, for not allowing foreign substances dispersing and staying in the transfer liquid L to approach (be attached to) the design surface S1 as possibly as can, and the bubbles and the foreign substances generated due to the drops falling from the object W that has been antecedently pulled up and the like are kept far away from the design surface S1 and are discharged outside the tank. Accordingly, it is preferable that the design surface oppositely-separating flow is formed by using clean water not containing any foreign substances or cleaned water acquired by eliminating foreign substances from the collected liquid (these will be collectively referred to as new water).

Given such a situation, for example, as illustrated in FIG. 10(*a*), the design surface cleaning mechanism 10 is formed to include the overflow tank 102 as the oppositely-separating flow forming means 101 on the design surface S1 side of the object W getting out from the liquid-leaving area Z4. Described in more detail, in this embodiment, since the object W floats in a state in which the design surface S1 is positioned obliquely toward the lower side in the liquid-leaving area Z4, the overflow tank 102 is disposed so as to be confronted by (to face) the design surface S1 of the object W, whereby the design surface oppositely-separating flow from the lower side of the object W (design surface S1) getting out of the liquid toward the upper side is formed. Here, in the overflow tank 102, a collection port that introduces mainly new water together with the transfer liquid L is set as a discharge port 103 in the overflow tank 102.

Next, it will be described that foreign substances may be easily attached to the design surface S1 in a case where there is no design surface cleaning mechanism 10. Commonly, the object W that is pulled up from the transfer tank 2 in which a liquid flow is formed floats in the state of blocking the considerable flow of the transfer liquid L from the upstream toward the downstream. At this time, the transfer liquid L that has been blocked flows to go around the lower side or the lateral side of the object W, and this forms the flow (wraparound flow) toward the design surface S1 that faces the downstream side.

In addition, when the object W is pulled up from the liquid, due to a speed difference between the pull-up speed of the object W and the staying liquid surface, a force flowing from an area near the liquid surface of the object W toward the object W is applied.

Given such a situation, a flow (a flow toward the design surface S1) wrapping around the design surface S1 is formed for the object W getting out of the liquid. Accordingly, in the state, foreign substances dispersing and staying in the transfer liquid L may approach the design surface S1 so as to be attached thereto. Accordingly, in this embodiment, the flow of the transfer liquid L toward the design surface S1 is eliminated or is suppressed as possibly as can by using the design surface oppositely-separating flow according to the design surface cleaning mechanism 10.

In addition, in the overflow tank 102 used for forming the design surface oppositely-separating flow, as illustrated in FIG. 10(*b*) as an example, a flow rate increase brim 104 is formed in the discharge port 103. This is for increasing the flow rate of the transfer liquid L introduced into the overflow tank 102.

As the oppositely-separating flow forming means 101 of the design surface cleaning mechanism 10, not only the above-described overflow structure but also another discharging technique may be employed. For example, as illustrated in FIG. 10(*c*), there is a vacuum technique for sucking the transfer liquid L containing foreign substances and new water mainly near the liquid surface. In other words, in such a case, as the oppositely-separating flow forming means 101, a sucking nozzle 105 is used.

Figure 11:
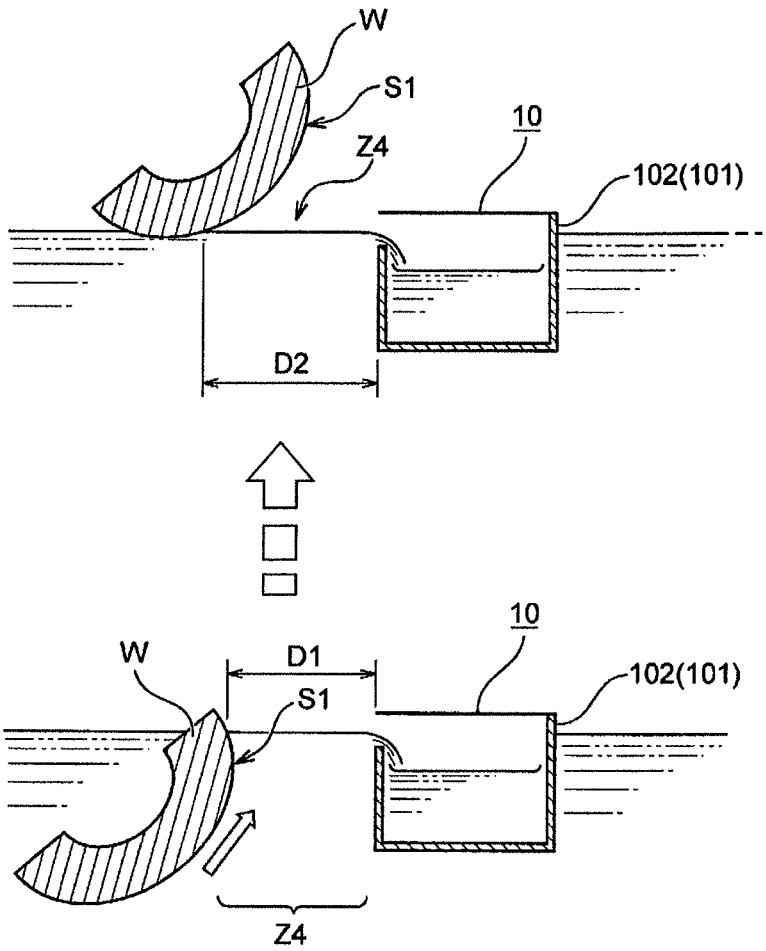
FIG. 11 is an explanatory diagram illustrating a design surface slowly getting away from the overflow tank for forming an oppositely-separating flow on the design surface due to a curved state, the degree of projection and depression, and the like of an object even in a case where the object is pulled up at a constant inclined posture and liquid-leaving angle.

In order to reliably and uniformly cause the design surface oppositely-separating flow to act on the design surface S1 of the object W from the start of the liquid leaving to the end of the liquid leaving, it is preferable to maintain a distance between the overflow tank 102 (discharge port 103) as a oppositely-separating flow forming means 101 and the object W (design surface S1) to be almost constant (for example, about 10 to 200 mm). However, for example, as shown in FIG. 11, depending on, e.g., the state of the curve and the degree of projections and depressions of the object W (design surface S1), the design surface S1 may gradually move away from the overflow tank 102 (discharge port 103) even if the object W is pulled up at a constant inclined posture liquid-leaving angle (in the figure, "D1" denotes the distance between them both as soon as the object W begins to move out of the liquid, and "D2" denotes the distance between them both when the object W has been moved out of the liquid). Therefore, the overflow tank 102 is preferably configured to be able to move in the longitudinal direction of the transfer tank 2 (the direction of the flow of the liquid/the direction from the transfer area Z3 to the liquid-leaving area Z4), in other words, configured to be able to approach and move away with respect to the object W which is moving out of the liquid. It is to be understood that as long as the discharge force (collecting force) of the transfer liquid L in the overflow tank 102 can be changed as necessary or in short, as long as the strength of the design surface oppositely-separating flow can be changed as necessary, the same effects can be achieved by increasing the collecting force of the transfer liquid L (the sucking force of the transfer liquid L) even if the object W relatively moves away while it gets out of the liquid. By the way, an example of other methods for increasing the collecting force includes decreasing the overflow tank 102.

Figure 12:
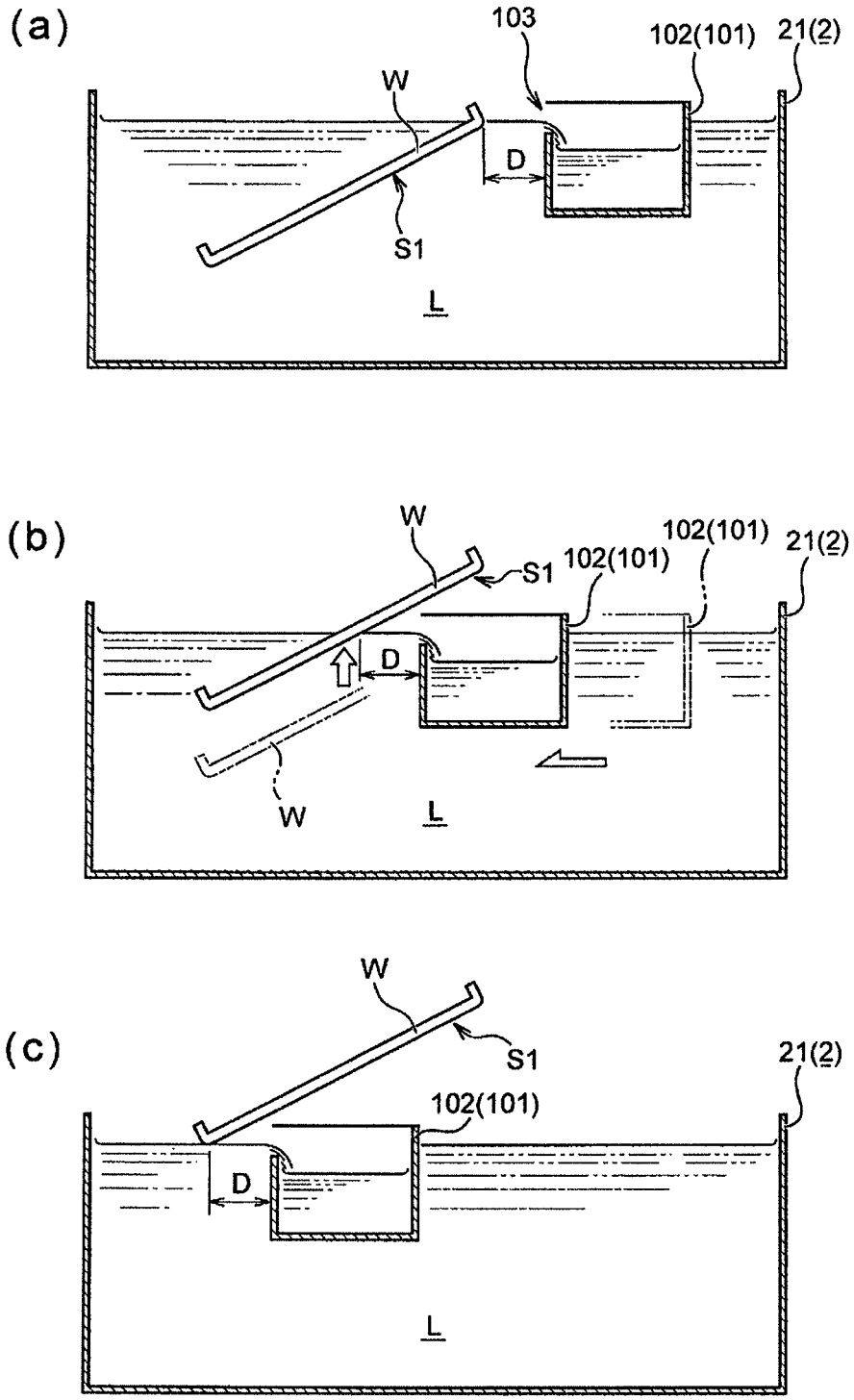
FIG. 12 is an explanatory diagram illustrating a preferred operating status of the overflow tank for forming an oppositely-separating flow on the design surface in a stepped manner in a case where the liquid pressure transfer is performed in a batch process, in other words, in a case where an object is pulled up straight in a constant inclined posture.

In addition, in the batch-type liquid pressure transfer, it is preferable that the liquid-leaving position of the object W (in other words, a distance between the object W and the overflow tank 102) with respect to the overflow tank 102 is maintained to be constant by moving the overflow tank 102 in the longitudinal direction (the direction from the transfer area Z3 to the liquid-leaving area Z4) of the transfer tank 2. Here, in the batch-type liquid pressure transfer, for example, as illustrated in FIG. 12, the object W is appropriately inclined, and, generally, the immersion direction and the liquid-leaving direction are set to the vertical direction (perpendicular direction). In other words, generally, the object W is immersed into the transfer tank 2 from right above, and the object W gets out of the liquid to the upper side straight above. Here, the embodiment illustrated in FIG. 12 illustrates the appearance of gradually pulling up the object W immersed at an appropriate inclined posture from the transfer tank 2 in a stepped manner. In addition, in the batch-type liquid pressure transfer, as illustrated in this figure, since an interval between the object W (design surface S1) and the overflow tank 102 for forming the design surface oppositely-separating flow tends to gradually increase as the object W gets out of the liquid, it is preferable that the overflow tank 102 is caused to gradually approach the object W during the liquid-leaving operation, and a distance ("D" in the figure) between the object W and the overflow tank 102 is maintained to be approximately constant (for example, about 100 mm).

Here, in arranging the overflow tank 102 used for forming the design surface oppositely-separating flow, the overflow tank is disposed in the terminal end portion of the transfer tank 2 in two stages. In other words, in the embodiment illustrated in FIG. 10, on the previous stage (upstream side) of the overflow tank 23A (overflow unit 23) collecting foreign substances such as film scraps together with the transfer liquid L in the terminal end portion of the transfer tank 2, the overflow tank 102 used for forming the design surface oppositely-separating flow is arranged, which forms a two-stage configuration. Here, the structure in which the overflow tanks are arranged in parallel with each other in two stages is called a "two-stage OF structure" (here, the "OF" represents overflow"), and, in a case where the overflow tanks 102 and 23A are represented more simply, the overflow tank 102 used for forming the design surface oppositely-separating flow will be referred to as a "first-stage OF tank", and the overflow tank 23A disposed on the downstream (rear end side) thereof will be referred to as a "second-stage OF tank".

Hereinafter, the operation and the advantages (the liquid flow in the transfer liquid) of the two-stage OF structure will be described.

According to the two-stage OF structure, the flow of the liquid inside the transfer tank 2 is controlled as below on the whole. First, the flow of the liquid inside the transfer tank 2, for example, as illustrated in FIG. 13, is classified into the following three types depending on the depth (height) in the liquid.

near upper layer (upper layer stream): broken line in the figure near middle layer (middle layer stream): solid line in the figure near lower layer (lower layer stream): dashed-dotted line in the figure Here, the middle layer stream flows at an almost same height in the first-stage OF tank 102, the OF tank 102 acts as a baffle plate (standing wall) for the flow of the liquid to be resistance for the liquid flow, and the flow is mainly considered as a flow that flows through the lower side of the OF tank 102. On the other hand, it is considered that there is no resistance for the liquid flow on the upper side and the lower side of the middle layer stream (or the influence of the resistance of the first-stage OF tank 102 is extremely small), and the upper layer stream and the lower layer stream are considered to flow almost horizontally along the flow of the liquid.

It is to be understood that a "layer" described here is a term conveniently used for the discrimination of a depth (height) in the transfer liquid, and, as is represented by the middle layer (middle layer stream), the actual flow does not form a layer as a whole (the stream does not flow in a layered state).

From such a viewpoint, the flows in the transfer liquid are understood as being summarized as below (see FIG. 13).

First, before the first-stage OF tank 102 (until the first-stage OF tank 102 becomes resistance for the liquid flow), the upper layer stream, the middle layer stream, and the lower layer stream flow at an almost same speed in the same horizontal direction.

Then, near (immediately before) the first-stage OF tank 102, as described above, only the upper layer stream near the liquid surface is collected by the first-stage OF tank 102 for forming a design surface oppositely-separating flow. At this time, since a flow rate increase brim 104 is included in the OF tank 102, the upper layer stream collected by the OF tank 102 is accelerated in the horizontal direction.

In addition, since the first-stage OF tank 102 becomes resistance for the liquid flow, the middle layer stream mainly becomes a liquid flow (this is referred to as a downward flow) that gets also into the lower side of the first-stage OF tank 102 so as to slip through this. Since the first-stage OF tank 102 becomes resistance for the liquid flow, the speed of this downward flow is understood to be lowered. After slipping through the OF tank 102, the middle layer stream that gets also into the lower side of the first-stage OF tank 102 becomes an upward flow this time (this is referred to as an upward flow). Since this upward flow is a flow after opening the resistance for the liquid flow, the speed thereof is understood to be lowered. In addition, the upward flow of the middle layer stream is understood to operate to pull up the downward layer stream. Thereafter, although the upward flows of the middle layer stream and the lower layer stream are collected in the second-stage OF tank 23A, this collection may be performed by the whole wall surface of the terminal end of the transfer tank 2.

Here, the operation and the advantages of the flow (reference numeral "P1" in the figure) of the middle layer stream getting also into the lower side of the first-stage OF tank 102 will be described.

In order to pull up the object W from the transfer liquid L, as described above, while the transfer liquid L containing foreign substances flows to go round the design surface S1 facing the downstream side just as it is, such an impinging stream (roundabout flow) is understood to be generated near the middle layer stream in which the object W operates to block the liquid flow as well as near the upper layer. However, in this embodiment, since the middle layer stream flows downward so as to get also into the lower side of the first-stage OF tank 102, this operates to offset the impinging stream formed near the middle layer, and the opening of the middle layer stream in the design surface S1 is prevented, and furthermore, the attachment of foreign substances contained in the middle layer stream to the design surface S1 is prevented.

In addition, in this embodiment, a boundary is formed (assumed) between the middle layer stream and the lower layer stream (particularly, reference numeral "P2" in the figure that is disposed on the lower side of the first-stage OF tank 102), and the operation and the advantages thereof will be described.

While the speed of the middle layer stream is lowered by the resistance of the first-stage OF tank 102 so as to form a downward flow, the lower layer stream is understood to directly flow to the downstream in the state in which the speed and the direction are maintained (a stable liquid flow state is maintained). Accordingly, the foreign substances of the middle layer stream is suppressed from falling and depositing on the upper surface of the lower layer stream (this is referred to as a curtain effect according to a liquid flow in which the lower layer stream is stable). In addition, on the lower side of the first-stage OF tank 102, an interval (the depth of the transfer tank 2) between the OF tank 102 and the bottom of the transfer tank 2 is the narrowest, whereby the speed of the middle layer stream increases. From these, the foreign substances contained in the middle layer stream is suppressed from being fallen and deposited to the bottom of the transfer tank in the boundary portion between the middle layer stream and the lower layer stream (the boundary portion functions to prevent sedimentation near the transfer area).

Next, the operation and the advantages of a portion (reference numeral "P3" in the figure) at which the middle layer stream becomes an upward flow will be described.

When the middle layer stream slips through the lower side of the first-stage OF tank 102, the resistance for the liquid flow disappears so as to open the upper side, the speed of the middle layer stream is lowered, and the upward flow is promoted. In addition, the speed of the lower layer stream is lowered in accordance with this, and, from this, an agitation phenomenon that may easily occur due to a grinding effect of foreign substances is suppressed, thereby operating such that the foreign substances disposed near the boundary between the middle layer stream and the lower layer stream are prevented from being broken and scattered. Accordingly, near the middle layer and the lower layer of the transfer tank 2, the collection of foreign substances is promoted, and the foreign substances are further prevented from being deposited on the bottom of the transfer tank 2.

In addition, in this embodiment, an inclined plate 25 is provided on the lower side (the corner portions of the transfer tank 2) of the second-stage OF tank 23A, and hereinafter, the operation and the advantages thereof will be described.

While the inclined plate 25 is responsible for an operation of allowing the lower layer stream to flow upward in the terminal end portion, it has a main role for performing support such that the rear end (downstream side) of the middle layer stream that becomes an upward flow has no defect by additionally allowing the lower layer stream to flow upward when the middle layer stream becomes the upward flow and conveys the foreign substances to the upper side after slipping through the lower side of the first-stage OF tank 102. From this, the foreign substances contained in the middle layer stream and the lower layer stream can be collected more efficiently.

Conventionally, while such an inclined plate may be present, the main purpose thereof is a taper process of the terminal end of the transfer tank for reducing the amount of liquid housing. It is to be understood that, in a conventional transfer tank, even when a phenomenon of inducing (guiding) the transfer liquid L (downward flow) to the upper side by using the inclined plate provided at the terminal end of the transfer tank occurs more or less, conventionally, there is no first-stage OF tank 102, and accordingly, there is no going-round (an upward flow from submerged inclusion) of the middle layer stream according to the OF tank 102, whereby, naturally, pulling-up of the lower layer stream according to this flow does not occur. In addition, since there is no first-stage OF tank 102, the flow of the middle layer stream is in the horizontal direction, and even if the pulling-up of the transfer liquid according to the inclined plate can be expected, the horizontal flow of the middle layer stream acts to disturb the pulling-up of the lower layer stream, and consequently, only the middle layer stream is pulled up, and accordingly, pulling-up of foreign substances in the lower layer stream to the same degree as that of this embodiment cannot be expected.

In addition, the need for decreasing the amount of the transfer liquid L housed inside the transfer tank 2 increases in the aspects of the cost, the processing efficiency, and the environment (in both aspects of a burden for separating foreign substances to be wasted and a burden for filtering the liquid to be circulated).

Furthermore, since the liquid pressure transfer is a transfer technique using liquid pressure, the depth (depth MAX) of the transfer tank 2 is necessary for which the object W is completely immersed (buried) in the transfer liquid L, and this depth is not essential for over the entirety (entire length) of the transfer tank 2, and, for example, the depth may be secured from a transfer requiring section formed from the transfer area Z3 (immersion area Z3) to the liquid-leaving area Z4. Conversely, in a transfer not-requiring section such as a film supply end, such a depth does not necessarily need to be secured, and, from the viewpoint of decreasing the capacity inside the transfer tank 2 as described above, in this embodiment, the depth of the transfer tank 2 is formed to be thin in the transfer not-requiring section. More specifically, for example, as illustrated in FIGS. 2, 10, and 13, the film supply side (upstream side) of the transfer tank 2 is formed to be thin over a suitable length, and, in the portion of a middle stream area following this, the bottom of the tank is formed in an inclined shape and is formed to have the depth that gradually increases, and the entire transfer tank 2 is formed in an approximate trapezoidal shape that is narrowed downward when seen from the side face. Here, reference numeral 26 represented in the figure is an inclined part formed in an inclined state in the portion of the middle stream area of the transfer tank 2. In addition, in a case where the transfer area Z3 (immersion area) and the liquid-leaving area Z4 is separated away from each other more or less (for example, see the above-described embodiment represented in FIG. 10), a section (a section in which the object W is immersed) from this transfer area Z3 to the liquid-leaving area Z4 is the transfer requiring section but is not limited to being a section (a section having a suitable distance) that is clearly discriminated, and, for example, in a liquid pressure transfer in which the transfer area Z3 and the liquid-leaving area Z4 almost match each other, only the transfer area Z3 is the transfer requiring section.

As described above, the first-stage OF tank 102 forms an upward flow by allowing the middle layer stream to slip therethrough, and this upward flow contributes to the pulling-up of the lower layer stream and the prevention of sedimentation and the collection of foreign substances (conveyance to the second-stage OF tank 23A), and the like. Accordingly, for example, as illustrated in FIG. 13(*b*), in a case where the first-stage OF tank 102 is configured to be stretchable in the direction of the flow of the liquid (the longitudinal direction of the transfer tank 2), the upward flow of the middle layer stream, the pulling up of the lower layer stream, and the like can be appropriately controlled.

The invention claimed is:

1. A method for activating a transfer film in which a transfer film formed by forming at least a transfer pattern in a dry state in a water-soluble film is supplied to a liquid surface inside a transfer tank in a state in which the transfer pattern faces the upper side, and then, the transfer pattern formed on the transfer film is activated by applying an activating agent from the upper side of the transfer film, wherein, in the transfer tank, a pre-activation guide mechanism holding both sides of the transfer film at horizontally equivalent positions from the transfer film supplied to the liquid surface disposed at the center of the transfer tank and guiding the transfer film to an activation area is disposed, and swelling of the transfer film is urged in the thickness direction while the transfer film is held by the pre-activation guide mechanism, and wherein, in the activation area, the transfer film is coated with the activating agent in a state in which the guiding action of the transfer film according to the pre-activation guide mechanism is cancelled.

2. The method for activating a transfer film according to claim 1, wherein, in the activation of the transfer film in the activation area, the elongation and expansion suppression state of ink that is in the dry state is canceled at once, and the transfer film is caused to swell to be horizontally equivalent without any distortion in the widthwise direction by urging the transfer film before activation to swell in the thickness direction using the pre-activation guide mechanism, releasing the holding of both sides of the transfer film according to the pre-activation guide mechanism right before the activation area, and coating the transfer film with the activating agent in this state.

3. The method for activating a transfer film according to claim 1, wherein, in a later stage of the activation area, a post-activation guide mechanism that holds both sides of the transfer film elongating and expanding in the widthwise direction according to the activation at horizontally equivalent positions from the center of the transfer tank and guiding the transfer film to a transfer area is disposed.

4. The method for activating a transfer film according to claim 1, wherein, in coating the transfer film disposed on the surface of a transfer liquid in the activation area with the activating agent, a spray gun spraying the activating agent applies the activating agent up to the outside of the both sides of the transfer film while reciprocating in the widthwise direction of the transfer film, and wherein, a removing means is disposed in outer portions of the both sides of the transfer film in the activation area, the removing means discharges an unnecessary activating agent component that has been applied to the film on the surface of the transfer liquid and floats on the liquid surface together with the transfer liquid, and the removing means also sucks the activating agent floating and scattering inside a hood covering the activation area at the same time and discharges the activating agent together with the transfer liquid in a mixed manner.

5. The method for activating a transfer film according to claim 4, wherein, in a position right before a contact of the transfer film elongating and expanding in the widthwise direction in accordance with the activation with the post-activation guide mechanism, a removing means for sending an activating agent component floating between the post-activation guide mechanism and the transfer film on the surface of the transfer liquid to a portion to which the unnecessary activating agent component on both sides of the activation area is discharged together with the transfer liquid or to a place between a side wall of the transfer tank and the post-activation guide mechanism.

6. The method for activating a transfer film according to claim 1, wherein, in supplying the transfer film to the surface of the transfer liquid, on a stage before the supply of the transfer film to the transfer tank, curl preventing projections and depressions resisting against a curl having a stripe pattern in the widthwise direction of the transfer film are formed in portions of the both sides of the transfer film.

7. A liquid pressure transfer method in which a transfer film formed by forming at least a transfer pattern on a water-soluble film in a dry state is supported to float on a liquid surface inside a transfer tank, an object is pressed from the upper side, and the transfer pattern is transferred mainly to a design surface side of the object in accordance with liquid pressure generated by pressing the object, wherein, in activating the transfer film, the transfer film is activated using an activation method according to claim 1.

8. The liquid pressure transfer method according to claim 7, wherein an overflow unit is disposed on the downstream side of the transfer tank, foreign substances such as a remaining film and the like are deposited and removed from a liquid collected by the overflow unit, the temperature of the collected liquid is adjusted, and then, the collected liquid is cyclically supplied from the upstream side of the transfer tank, and wherein the object pulled up from the transfer tank is then sent to a film detachment cleaning process, the water-soluble film of the surface is dissolved and cleaned in the film detachment cleaning process, and discharged cleaning water containing the dissolved water-soluble film that is generated in the process is cyclically supplied to a position right before the overflow unit of the transfer tank.

9. The liquid pressure transfer method according to claim 7, wherein, in the transfer tank, in a liquid-leaving area in which the object is pulled up from the transfer liquid, a design surface oppositely-separating flow that flows away from the design surface of the object getting out of the liquid is formed, and bubbles disposed on the surface of the transfer liquid and foreign substances staying in the liquid are placed far from the design surface of the object getting out of the liquid and are discharged to the outside of the transfer tank.

10. The liquid pressure transfer method according to claim 9, wherein, in a previous stage of the overflow unit, an overflow tank facing the design surface of the object getting out of the liquid is further disposed, and the design surface oppositely-separating flow is formed by the overflow tank.

11. A liquid pressure transfer device comprising:

a transfer tank that stores a transfer liquid;

a transfer film supply device that supplies a transfer film to the transfer tank;

an activating agent apply device that coats the transfer film supplied to the liquid surface of the transfer tank with an activating agent to be in a transferrable state; and an object conveying device that presses an object to the transfer film that is in an activated state on the liquid surface of the transfer tank by the activating agent from the upper side, wherein the transfer film formed by forming at least a transfer pattern in a water-soluble film in a dry state is supported to float on the liquid surface inside the transfer tank, and the transfer pattern is transferred to mainly the design surface side of the object in accordance with liquid pressure generated by pressing the object from the upper side, wherein, in the transfer tank, a pre-activation guide mechanism holding both sides of the transfer film at horizontally equivalent positions from the transfer film supplied to a liquid surface disposed at the center of the transfer tank and guiding the transfer film to an activation area is disposed, and swelling of the transfer film is urged in the thickness direction while the transfer film is held by the pre-activation guide mechanism, and wherein, in the activation area, the transfer film is coated with the activating agent in a state in which the guiding action of the transfer film according to the pre-activation guide mechanism is cancelled.

12. The liquid pressure transfer device according to claim 11, wherein, in a later stage of the activation area, a post-activation guide mechanism that holds both sides of the transfer film elongating and expanding in the widthwise direction according to the activation at horizontally equivalent positions from the center of the transfer tank and guiding the transfer film to a transfer area is disposed.

13. The liquid pressure transfer device according to claim 11, wherein the activating agent apply device includes a spray gun that sprays the activating agent, and the spray gun applies the activating agent up to the outer sides of the both sides of the transfer film while reciprocating in the widthwise direction of the transfer film in the activation area, and wherein, a removing means is disposed in outer portions of the both sides of the transfer film in the activation area, the removing means discharges unnecessary activating agent component that has been applied to the film on the surface of the transfer liquid and floats on the liquid surface together with the transfer liquid, and the removing means also sucks the activating agent floating and scattering inside a hood covering the activation area at the same time and discharges the activating agent together with the transfer liquid in a mixed manner.

14. The liquid pressure transfer device according to claim 13, wherein, on both sides of the activation area, in a suction port of the removing means discharging and collecting the unnecessary activating agent component together with the transfer liquid, fillers promoting an air-liquid contact between the air containing the unnecessary activating agent component and the collected liquid are disposed, a mist separator in which fillers promoting an air-liquid contact between the air containing the unnecessary activating agent component and the collected liquid, and a demister are built is disposed on a later stage of the water discharge side of the collected liquid of the removing means, and an air discharge fan is disposed on a further later stage, and wherein the air containing the unnecessary activating agent component is discharged from the air discharge fan to the outside after cleaning the air by causing the activating agent component to be dissolved into the collected liquid according to such a configuration.

15. The liquid pressure transfer device according to claim 13, wherein, in a position right before a contact of the transfer film elongating and expanding in the widthwise direction in accordance with the activation with the post-activation guide mechanism, a removing means for sending an activating agent component floating between the post-activation guide mechanism and the transfer film on the surface of the transfer liquid to a portion to which the unnecessary activating agent component on both sides of the activation area is discharged together with the transfer liquid or to a place between a side wall of the transfer tank and the post-activation guide mechanism.

16. The liquid pressure transfer device according to claim 11, wherein the transfer film supply device includes a projection/depression molding roller that forms projections and depressions having a stripe pattern for preventing a curl that resist against a curl in the widthwise direction of the film or a laser marker that forms projections and depressions for preventing a curl as fine projections and depressions in portions of the both sides of the transfer film before the supply to the transfer tank.

17. The liquid pressure transfer device according to claim 11, wherein the pre-activation guide mechanism is configured by a conveyer formed by winding an endless belt around a pulley, and wherein a rotation axis of the pulley is set to an approximately vertical direction, and the widthwise direction of the wound belt is set to the height direction of the surface of the transfer liquid.

18. The liquid pressure transfer device according to claim 12, wherein the post-activation guide mechanism is handled even after the transfer area such that a guide member holding the both sides of the transfer film in the pre-activation guide mechanism avoids the activation area, and the both sides of the transfer film elongating and expanding according to the activation are held by the guide member that is the same as the pre-activation guide mechanism.

19. The liquid pressure transfer device according to claim 11, wherein an overflow unit is disposed on the downstream side of the transfer tank, foreign substances such as a remaining film and the like are deposited and removed from a liquid collected by the overflow unit, the temperature of the collected liquid is adjusted, and then, the collected liquid is cyclically supplied from the upstream side of the transfer tank using a circulating pipe path, wherein a film detachment cleaning device that cleans the surface of the object pulled up from the transfer tank is included in a later stage of the transfer tank, and the water-soluble film attached to the surface of the object is dissolved to be cleaned and removed by the film detachment cleaning device, wherein this film detachment cleaning device is formed by being connected to the transfer tank using a circulating water discharge pipe path, and wherein discharged cleaning water containing the dissolved water-soluble film that is generated in the film detachment cleaning process is cyclically supplied to a position right before the overflow unit of the transfer tank.

20. The liquid pressure transfer device according to claim 11, wherein, in a liquid-leaving area in which the object is pulled up from the transfer liquid, an oppositely-separating flow forming means that acts on the design surface of the object floating from the transfer liquid is disposed, a design surface oppositely-separating flow that flows away from the design surface of the object getting out of the liquid is formed, and bubbles disposed on the surface of the transfer liquid and foreign substances staying in the liquid are placed far from the design surface of the object getting out of the liquid and are discharged to the outside of the transfer tank in accordance with the design surface oppositely-separating flow.

21. The liquid pressure transfer device according to claim 20, wherein, in a previous stage of the overflow unit, an overflow tank facing the design surface of the object getting out of the liquid is further disposed, and the design surface oppositely-separating flow is formed by the overflow tank.

* * * * *